US009426595B2

(12) United States Patent
Nakano

(10) Patent No.: US 9,426,595 B2
(45) Date of Patent: Aug. 23, 2016

(54) SIGNAL PROCESSING APPARATUS, SIGNAL PROCESSING METHOD, AND STORAGE MEDIUM

(75) Inventor: Kenji Nakano, Kanagawa (JP)

(73) Assignee: Sony Corporation, Tokyo (JP)

( * ) Notice: Subject to any disclaimer, the term of this patent is extended or adjusted under 35 U.S.C. 154(b) by 1439 days.

(21) Appl. No.: 12/351,939

(22) Filed: Jan. 12, 2009

(65) Prior Publication Data

US 2009/0180626 A1 Jul. 16, 2009

(30) Foreign Application Priority Data

Jan. 15, 2008 (JP) ..... 2008-006019

(51) Int. Cl.

| | |
|---|---|
| ***H04R 5/00*** | (2006.01) |
| ***H04S 3/00*** | (2006.01) |
| *H04R 3/14* | (2006.01) |

(52) U.S. Cl.

CPC ... *H04S 3/00* (2013.01); *H04R 3/14* (2013.01); *H04S 2400/01* (2013.01)

(58) Field of Classification Search

CPC ..... H04S 3/00; H04S 2400/01; H04S 1/002; H04S 5/00; H04S 2420/01; H04R 3/14

USPC ..... 381/99, 17, 310, 309, 300, 307; 382/118, 115, 103; 348/14.16, 169

See application file for complete search history.

(56) References Cited

U.S. PATENT DOCUMENTS

| | | | | |
|---|---|---|---|---|
| 5,757,931 | A * | 5/1998 | Yamada et al. | 381/61 |
| 6,741,273 | B1 * | 5/2004 | Waters et al. | 348/61 |
| 7,072,474 | B2 * | 7/2006 | Nelson et al. | 381/17 |
| 2002/0061114 | A1 * | 5/2002 | Croft, III | 381/345 |
| 2004/0032955 | A1 * | 2/2004 | Hashimoto et al. | 381/18 |
| 2004/0223620 | A1 * | 11/2004 | Horbach et al. | 381/59 |
| 2005/0190925 | A1 * | 9/2005 | Miura et al. | 381/17 |
| 2005/0190936 | A1 * | 9/2005 | Miura et al. | 381/309 |
| 2006/0251272 | A1 * | 11/2006 | Horbach | 381/99 |
| 2008/0031473 | A1 * | 2/2008 | Yarygin et al. | 381/97 |
| 2008/0159571 | A1 * | 7/2008 | Hooley | 381/307 |
| 2009/0304213 | A1 * | 12/2009 | Cook et al. | 381/300 |
| 2011/0033070 | A1 * | 2/2011 | Obata et al. | 381/303 |

FOREIGN PATENT DOCUMENTS

| | | |
|---|---|---|
| JP | 05-260597 | 10/1993 |
| JP | 09-238400 | 9/1997 |
| JP | 2005-223713 A | 8/2005 |
| JP | 2006-304068 A | 11/2006 |

* cited by examiner

*Primary Examiner* — Vivian Chin

*Assistant Examiner* — Con P Tran

(74) *Attorney, Agent, or Firm* — Chip Law Group

(57) ABSTRACT

A signal processing apparatus includes a low-pass-filter processing unit configured to perform processing for limiting a band of an input audio signal on the basis of a cutoff frequency; a high-pass-filter processing unit configured to perform processing for limiting a band of the input audio signal on the basis of the cutoff frequency; a delay processing unit configured to perform processing for delaying the audio signal band-limited by the high-pass-filter processing unit; and a combination processing unit configured to combine the audio signal band-limited by the low-pass-filter processing unit and the audio signal subjected to the delay processing performed by the delay processing unit.

18 Claims, 15 Drawing Sheets

SIGNAL PROCESSING APPARATUS, SIGNAL PROCESSING METHOD, AND STORAGE MEDIUM

CROSS REFERENCES TO RELATED APPLICATIONS

The present invention contains subject matter related to Japanese Patent Application JP 2008-006019 filed in the Japanese Patent Office on Jan. 15, 2008, the entire contents of which are incorporated herein by reference.

BACKGROUND OF THE INVENTION

1. Field of the Invention

The present invention relates to a signal processing apparatus and a signal processing method which perform signal processing for expanding a service area having a sound-image localization effect on audio signals during sound reproduction for giving a virtual sound-image localization effect and to a storage medium that stores a program for realizing such signal processing.

2. Description of the Related Art

As disclosed in Laid-open Japanese Patent Application Publication No. 5-260597, for example, virtual sound-image localization processing is typically performed to virtually localize a sound image at a position that is different from the positions of speakers that actually reproduce sound, for example, to localize sound images at a rear left position and a rear right position, by reproducing sound by using two (left and right) channel front speakers.

In order to virtually localize a sound source, an ideal listening position of a listener relative to multiple speakers (e.g., for two (left and right) channels) to be disposed is pre-determined and transmission functions (G) of sounds output from the speakers (which actually reproduce the sounds) to both (left and right) ears of the listener and transmission functions (H) of sound output from a virtual sound image position to the both ears are pre-measured as transmission functions of sounds output from the speakers to the both ears of the listener who is at the ideal position. During actual processing, transmission functions based on the transmission function (G) and (H) are integrated, and the resulting signals are supplied to the speakers for output.

With this arrangement, only the use of, for example, two (left and right) channel front speakers allows a sound image to be virtually localized at arbitrary positions at, for example, a rear left position and a rear right position of the listener.

SUMMARY OF THE INVENTION

It is commonly known that, when virtual sound-image localization processing typified by the above-described scheme is performed, the service area of the sound-image localization is very small. In the virtual sound-image localization processing, the transmission functions are integrated based on the premise that the listener who listens to sound is at an ideal position. Thus, when the position of the listener moves from the ideal position, the sound-image localization effect decreases. In particular, with respect to leftward or rightward movement from the ideal position, the sound-image localization effect decreases sharply.

In view of such problems, it is desirable to expand the service area having the sound-image localization effect during reproduction of audio signals subjected to virtual sound-image localization processing.

According to an embodiment of the present invention, there is provided a signal processing apparatus. The signal processing apparatus includes: a low-pass-filter processing unit configured to perform processing for limiting a band of an input audio signal on the basis of a cutoff frequency, the cutoff frequency being determined based on a frequency at which a characteristic fluctuation appears in frequency characteristics with respect to combined sound at positions of ears of a listener who listens to sound output from speakers and being set for the low-pass-filter processing unit; a high-pass-filter processing unit configured to perform processing for limiting a band of the input audio signal on the basis of the cutoff frequency, the cutoff frequency being set for the high-pass-filter processing unit; a delay processing unit configured to perform processing for delaying the audio signal band-limited by the high-pass-filter processing unit; and a combination processing unit configured to combine the audio signal band-limited by the low-pass-filter processing unit and the audio signal subjected to the delay processing performed by the delay processing unit.

The reason why a sensation of virtual sound-image localization is reduced by position displacement from the ideal position of the listener is that the position displacement causes a difference in frequency characteristics with respect to combined sound of sounds output from the respective speakers and obtained at the positions of the ears of the listener. The reason why the position displacement causes the difference in the frequency characteristics at the positions of the ears is that, mainly in the frequency characteristics at the position of each ear, a large comb-teeth-shaped characteristic fluctuation occurs in a band that is higher than or equal to a frequency corresponding to the amount of position displacement.

Accordingly, in the configuration according to the embodiment of the present invention, the cutoff frequency determined based on the frequency at which such a characteristic fluctuation begins to appear is used to divide the input audio signals into low-frequency signals and high-frequency signals, the low-frequency signals are output earlier, and the high-frequency-side signals are subsequently output with a delay.

With such an arrangement, the so-called "precedence effect" allows a sensation of sound-image localization to be dominantly given by low-frequency-side signals that are output earlier and that have a small amount of characteristic fluctuation. As a result, even when the position of the listener is displaced in the left or right direction from the ideal position of the listener, it is possible to maintain the sensation of sound-image localization.

According to the present invention, during sound reproduction (virtual surround reproduction) for virtually localizing a sound image at a desired position by using multiple speakers, for example, two (left and right) channel speakers, it is possible to reduce loss of the sensation of sound-image localization even when the listener moves in the left or right direction. That is, it is possible to expand the service area having the sound-image localization effect.

DESCRIPTION OF THE PREFERRED EMBODIMENTS

Best modes (hereinafter referred to as "embodiments") for carrying out the present invention will be described below.

<First Embodiment>

[Reproducing Apparatus]

Figure 1:
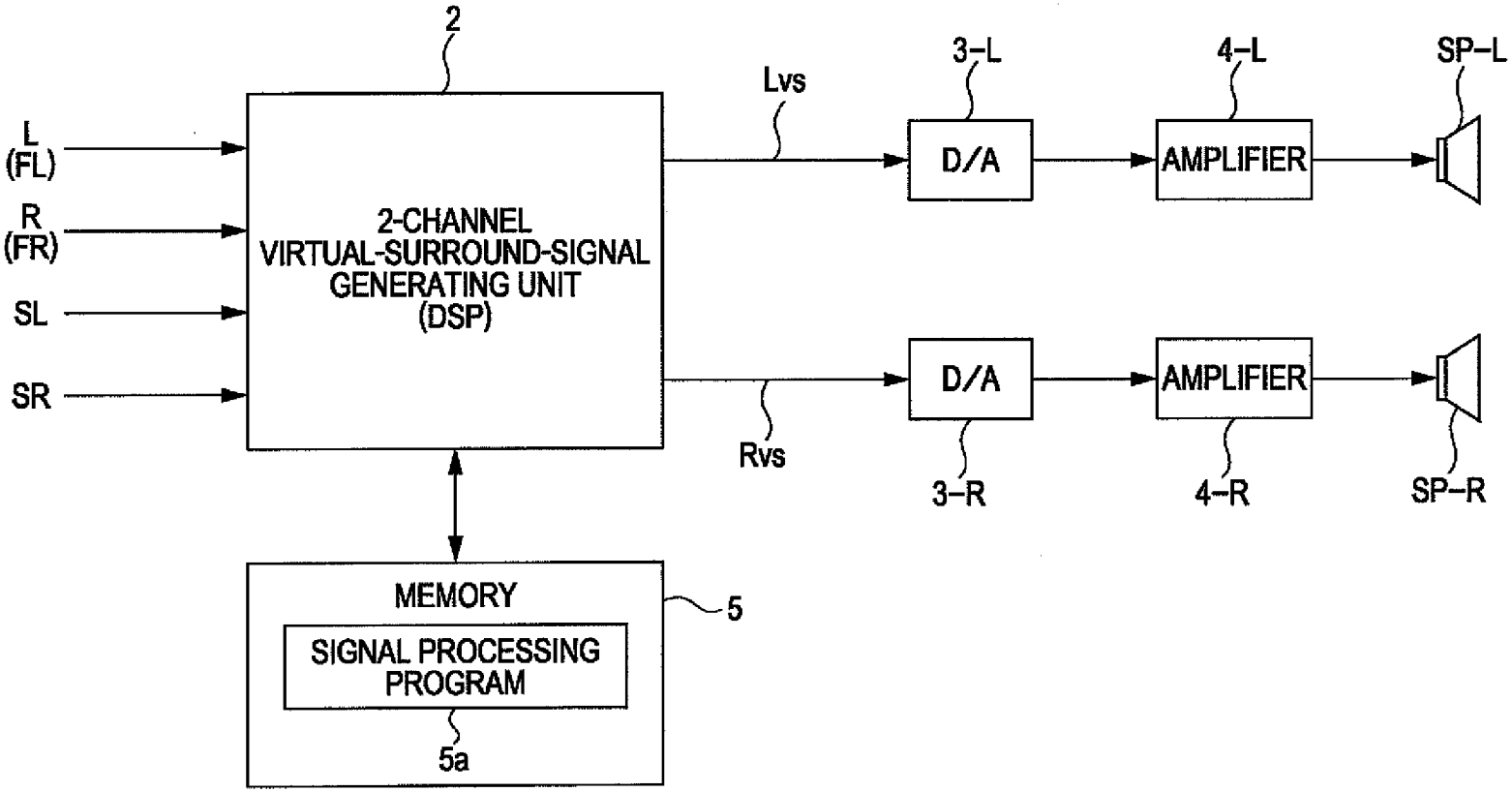
FIG. 1 is a block diagram showing the internal configuration of a reproducing apparatus that has a signal processing device according to a first embodiment of the present invention.

FIG. 1 is a block diagram showing the internal configuration of a reproducing apparatus 1 that has a signal processing device according to a first embodiment of the present invention to perform virtual surround reproduction.

As shown in FIG. 1, 4-channel audio signals, including a left-channel audio signal L, a right-channel audio signal R, a left-channel surround signal SL, and a right-channel surround signal SR, are input to the reproducing apparatus 1 as input signals. Two (left and right) channel virtual surround signals are generated from the 4-channel audio signals and are output from speakers SP-L and SP-R disposed at the front left side and the front right side of a listener, so that virtual surround reproduction is performed.

As can be understood from the above description, in this case, the left-channel audio signal L and the right-channel audio signal R become signals output from the front side of the listener. Thus, the left-channel audio signal L and the right-channel signal R are also referred to as an "audio signal FL (front left)" and an "an audio signal FR (front right)", respectively.

The left-channel surround signal SL becomes a signal to be output from the rear left side of the listener and the right-channel surround signal SR becomes a signal to be output from the rear right side of the listener. That is, the left-channel surround signal SL and the right-channel surround signal SR become signals to be output from virtual sound-image positions where actual speakers are not disposed.

In the reproducing apparatus 1, the two (left and right) channel speakers SP-L and SP-R at the front side are used to perform virtual surround reproduction so that the listener perceives the left and right surround signals SL and SR as if they were output from a rear left position and a rear right position, respectively.

In FIG. 1, the reproducing apparatus 1 includes a 2-channel virtual-surround-signal generating unit 2, digital/analog (D/A) converters 3-L and 3-R, amplifiers 4-L and 4-R, the speakers SP-L and SP-R, and a memory 5.

The 2-channel virtual-surround-signal generating unit 2 is implemented by a DSP (digital signal processor), and performs digital signal processing on the input audio signals L, R, SL, and SR, on the basis of a program stored in the memory 5.

In the present embodiment, the memory 5 stores a signal processing program 5*a* for causing the 2-channel virtual-surround-signal generating unit 2 implemented by the DSP to execute signal processing, described below, according to the present embodiment.

The 2-channel virtual-surround-signal generating unit 2 executes digital signal processing based on the signal processing program 5*a* to generate two (left and right) channel virtual surround signals Lvs and Rvs from the input audio signals L, R, SL, and SR. The virtual surround signals Lvs and Rvs are generated so that, when they are output from the front speakers SP-L and SP-R, they can be perceived as if the left-channel surround signal SL and the right-channel surround signal SR were output from the rear left side and the rear right side, respectively.

The left-channel virtual surround signal Lvs generated by the 2-channel virtual-surround-signal generating unit 2 is converted by the D/A converter 3-L into an analog signal. The analog signal is then amplified by the amplifier 4-L and the amplified signal is output as sound from the speaker SP-L, which is disposed at the front left side of the listener. The right-channel virtual surround signal Rvs generated by the 2-channel virtual-surround-signal generating unit 2 is converted by the D/A converter 3-R into an analog signal. The analog signal is amplified by the amplifier 4-R and the amplified signal is then output as sound from the speaker SP-R, which is disposed at the front right side of the listener.

[2-Channel Virtual-Surround-Signal Generating Unit]

Figure 2:
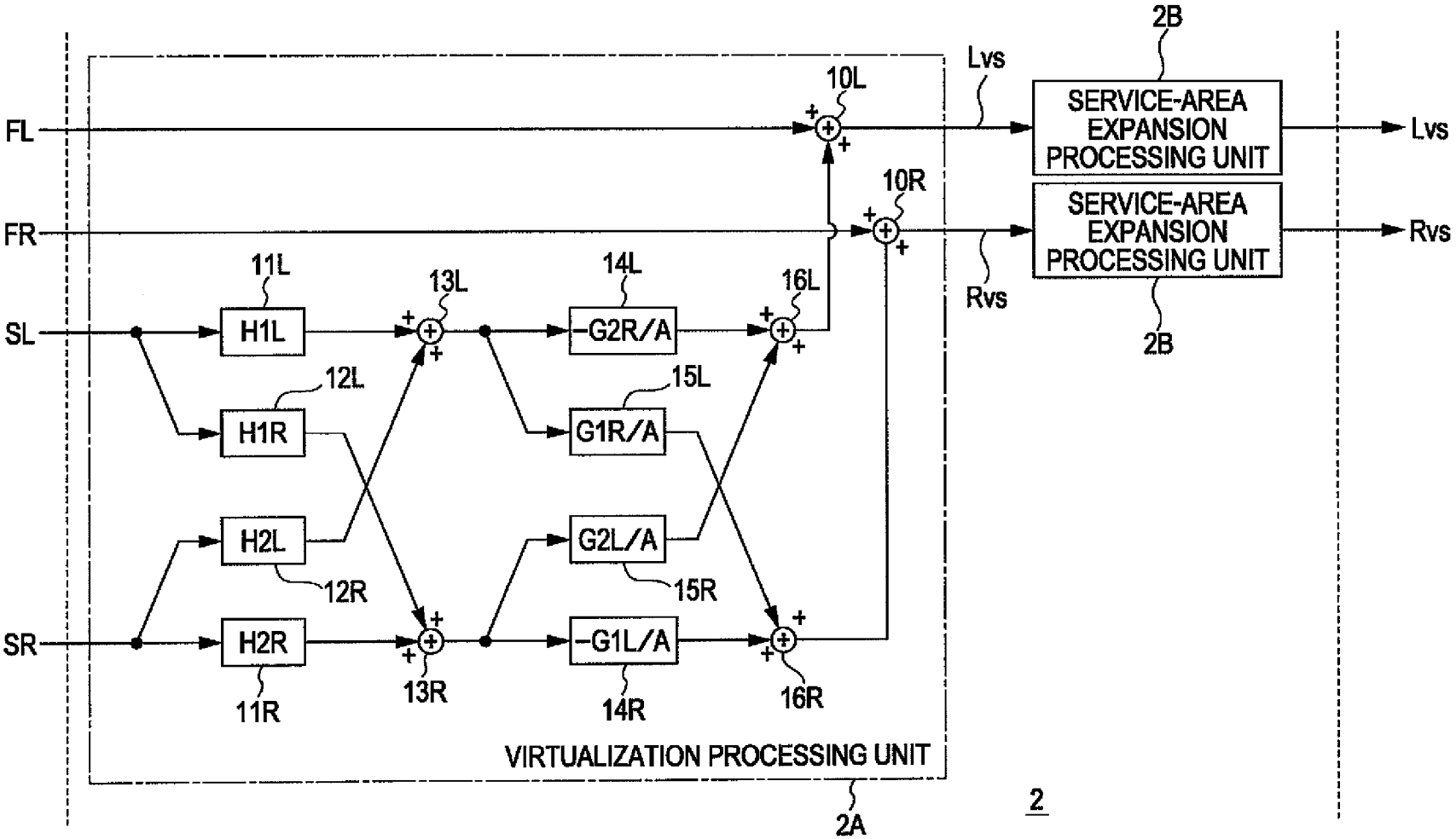
FIG. 2 is a block diagram showing functional operations realized by digital signal processing performed by a 2-channel virtual-surround-signal generating unit (DSP) in the first embodiment.

FIG. 2 is a block diagram of functional operations realized by the digital signal processing of the 2-channel virtual-surround-signal generating unit 2 shown in FIG. 1.

While each functional block is described below as hardware for convenience of description, the functional operation of each functional block is realized by the digital signal processing based on the signal processing program 5*a* in the memory 5, the digital signal processing being performed by the 2-channel virtual-surround-signal generating unit 2 implemented by the DSP.

The 2-channel virtual-surround-signal generating unit 2 includes a virtualization processing unit 2A and service-area expansion processing units 2B.

The virtualization processing unit 2A performs signal processing for generating the two (left and right) channel virtual surround signals Lvs and Rvs from the input audio signals L, R, SL, and SR. The service-area expansion processing units 2B perform signal processing for expanding a service area that provides a virtual sound-image localization effect, which is realized by sound reproduction of the virtual surround signals Lvs and Rvs. The service-area expansion processing according to the present embodiment, the service-area expansion processing being performed by the service-area expansion processing units 2B, is described below.

The left-channel audio signal FL, the right-channel audio signal FR, the left-channel surround signal SL, and the right-channel surround signal SR are input to the virtualization processing unit 2A. In the virtualization processing unit 2A, the left-channel audio signal FL is input to an addition processing unit 10L and the right-channel audio signal FR is input to an addition processing unit 10R.

The virtualization processing unit 2A includes filter processing units 11L, 11R, 12L, 12R, 14L, 14R, 15L, and 15R, and addition processing units 13L, 13R, 16L, and 16R.

The left-channel surround signal SL input to the virtualization processing unit 2A is split into a signal supplied to the filter processing unit 11L and a signal supplied to the filter processing unit 12L. The right-channel surround signal SR input to the virtualization processing unit 2A is split into a signal supplied to the filter processing unit 11R and a signal supplied to the filter processing unit 12R.

The addition processing unit 13L receives the left-channel surround signal SL processed by the filter processing unit 11L and the right-channel surround signal SR processed by the filter processing unit 12R and adds these surround signals SL and SR.

The addition processing unit 13R receives the right-channel surround signal SR processed by the filter processing unit 11R and the left-channel surround signal SL processed by the filter processing unit 12L and adds these surround signals SR and SL.

A result of the addition performed by the addition processing unit 13L is processed by the filter processing unit 14L and is then input to the addition processing unit 16L. The result of the addition performed by the addition processing unit 13L is also split and supplied to the filter processing unit 15L, is processed by the filter processing unit 15L, and is then input to the addition processing unit 16R.

A result of the addition performed by the addition processing unit 13R is processed by the filter processing unit 14R and is then input to the addition processing unit 16R. The result of the addition performed by the addition processing unit 13R is also split and supplied to the filter processing unit 15R, is processed by the filter processing unit 15R, and is then input to the addition processing unit 16L.

The addition processing unit 16L adds a signal processed by the filter processing unit 14L and a signal processed by the filter processing unit 15R. A result of the addition performed by the addition processing unit 16L is input to the addition processing unit 10L.

The addition processing unit 16R adds a signal processed by the filter processing unit 14R and a signal processed by the filter processing unit 15L. A result of the addition performed by the addition processing unit 16R is input to the addition processing unit 10R.

The addition processing unit 10L adds the input left-channel audio signal FL and the result of the addition performed by the addition processing unit 16L. A result of the addition performed by the addition processing unit 10L becomes the left-channel virtual surround signal Lvs.

The addition processing unit 10R adds the input right-channel audio signal FR and the result of the addition performed by the addition processing unit 16R. A result of the addition performed by the addition processing unit 10R becomes the right-channel virtual surround signal Rvs.

The left-channel virtual surround signal Lvs generated by the addition processing unit 10L is supplied to one of the service-area expansion processing unit 2B and the right-channel virtual surround signal Rvs generated by the addition processing unit 10R is supplied to the other service-area expansion processing unit 2B.

Filter characteristics that are to be given to the filter processing units in the virtualization processing unit 2A to cause perception as if the left and right surround signals SL and SR were output from the rear left and rear right, respectively, will now be described with reference to FIG. 3.

Figure 3:
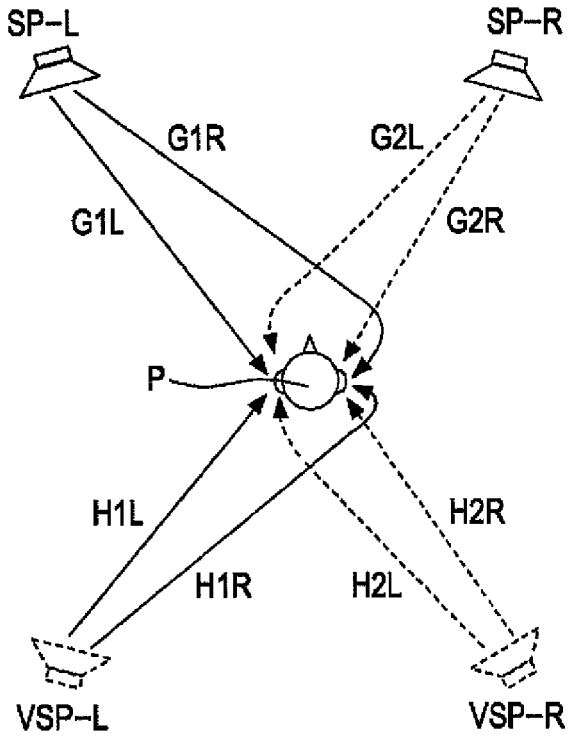
FIG. 3 illustrates sound transmission functions used for virtualization processing.

FIG. 3 is a schematic diagram showing transmission functions of sounds from the speakers SP-L and SP-R to the ears of a listener P and transmission functions of sounds from a rear-left virtual speaker VSP-L and a rear-right virtual speaker VSP-R (which are shown by dotted lines at virtual sound-source positions) to the ears of the listener P.

As shown in FIG. 3, a transmission function of sound from the rear-left virtual speaker VSP-L to the left ear of the listener P is indicated by H1L and a transmission function of sound from the virtual speaker VSP-L to the right ear of the listener P is indicated by H1R. Also, a transmission function of sound from the rear-right virtual speaker VSP-R to the left ear of the listener P is indicated by H2L and a transmission function of sound from the virtual speaker VSP-R to the right ear of the listener P is indicated by H2R.

In addition, a transmission function of sound from the front-left speaker SP-L to the left ear of the listener P is indicated by G1L and a transmission function of sound from the front-left speaker SP-L to the right ear of the listener P is indicated by G1R. A transmission function of sound from the front-right speaker SP-R to the left ear of the listener P is indicated by G2L and a transmission function of sound from the front-right speaker SP-R to the right ear of the listener P is indicated by G2R.

Filter characteristics based on the transmission of sound functions are set for the corresponding filter processing units shown in FIG. 2. More specifically, a filter characteristic (a filter coefficient) for giving the transmission function H1L is set for the filter processing unit 11L and a filter characteristic for giving the transmission function H2R is set for the filter processing unit 1R. A filter characteristic for giving the transmission function H1R is set for the filter processing unit 12L and a filter characteristic for giving the transmission function H2L is set for the filter processing unit 12R.

A filter characteristic for giving a transmission function expressed by −G2R/A is set for the filter processing unit 14L. In this case, A is given by:

$$A=G2L*G1R-G2R*G1L.$$

A filter characteristic for giving a transmission function expressed by −G1L/A is set for the filter processing unit 14R. In addition, a filter characteristic for giving a transmission function expressed by G1R/A is set for the filter processing unit 15L and a filter characteristic for giving a transmission function expressed by G2L/A is set for the filter processing unit 15R.

The filter processing units are implemented by, for example, finite impulse response (FIR) filters and perform filter processing based on the set filter characteristics on the input signals.

In cases in which it is not necessary to particularly consider the transmission function of sounds from the positions of sound sources, which actually output the sounds, to the ears of the listener P, such as a case in which virtualization processing is performed with a headphone set, the transmission function H1L and the transmission function H2L are integrated together with respect to the left-channel output signal heard by the left ear of the listener P and the transmission function H1R and the transmission function H2R are integrated together with respect to the right-channel output signal heard by the right ear of the listener P. That is, in such cases, the filter processing units 14L, 14R, 15L, and 15R and the addition processing units 16L and 16R can be eliminated from the configuration shown in FIG. 2.

In this example, however, since sounds are output from the speakers SP-L and SP-R disposed at certain distances from the listener P, it is generally necessary to perform virtualization processing that is also based on the transmission functions of sounds from the speakers SP-L and SP-R to the ears of the listener P. Thus, the configuration shown in FIG. 2 is adapted to provide an effect for cancelling influences associated with the transmission functions of sounds from the speakers SP to the ears of the listener P by giving "−G2R/G2L*G1R−G2R*G1L" (as "−G2R/A" noted above) and "G2L/G2L*G1R−G2R*G1L" (as "G2L/A" noted above) to the left-channel output signals to be heard by the left ear of the listener P and giving "−G1L/G2L*G1R−G2R*G1L" (as "−G1L/A" noted above) and "G1R/G2L*G1R−G2R*G1L" (as "G1R/A" noted above) to the right-channel output signals to be heard by the right ear of the listener P. With this arrangement, sounds output from the front left and right speakers SP-L and SP-R allow the sounds to be perceived as if the left-channel surround signal SL were output from the rear-left virtual speaker VSP-L and the right-channel surround signal SR were output from the rear-right virtual speaker VSP-R.

Although an example of a case in which a scheme based on the binaural processing is employed has been described above as one example of the virtualization processing, another scheme can also be employed for the virtualization processing. In any case, from the point of view of service-area expansion processing described below, any scheme may be employed for the virtualization processing, and the scheme is not particularly limited.

[Service-Area Expansion Processing]

Cause of Decrease in Sound-Image Localization Effect As can be understood from the above description, the reproducing apparatus 1 according to the present embodiment performs virtual surround reproduction for virtually localizing a sound image at a position other than the positions of the speakers SP that actually output sounds. As described above, however, the virtual sound-image localization effect obtained by such virtual surround reproduction has problems in that the service area is generally small and the virtual sound-image localization effect with respect to, particularly, leftward/rightward position displacement of the listener P decreases sharply.

A reason why the sound-image localization effect is reduced by the position displacement of the listener P, as described above, will now be described with reference to FIGS. 4A to 6C.

Figure 4A:
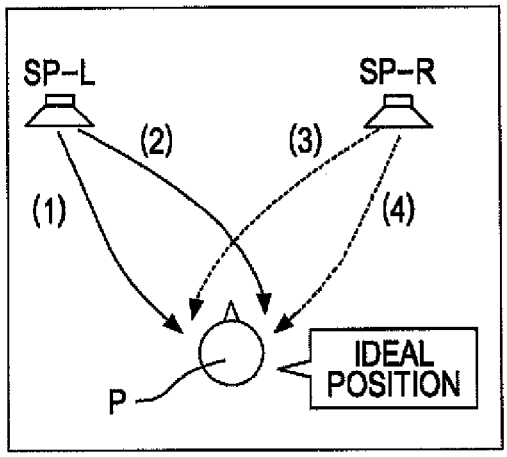
FIGS. 4A and 4B illustrate an arrival time difference between sounds output from the respective speakers and obtained at each ear of the listener when he or she is at an ideal listening position.
Figure 4B:
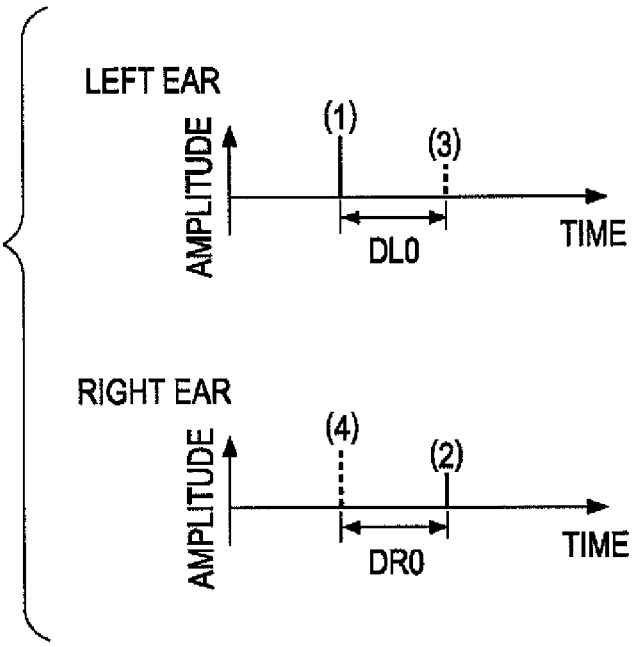

FIGS. 4A and 4B illustrate an arrival time difference between sounds output from the respective speakers SP-L and SP-R and obtained at each ear of the listener P when the listener P is at an ideal listening position. FIG. 4A schematically shows a state in which sounds output from the speakers SP-L and SP-R arrive at the ears of the listener P and FIG. 4B shows the amplitudes and the arrival times of sounds output from the speakers SP-L and SP-R and heard by the ears of the listener P in the state shown in FIG. 4A.

First, as shown in FIG. 4A, it is assumed in this example that the ideal listening position (also referred to as the "ideal position") of the listener P lies on the central axis between the left speaker SP-L and the right speaker SP-R. In other words, the speakers SP-L and SP-R are disposed according to a symmetrical positional relationship of the speakers SP-L and SP-R, viewed from the listener P. In this case, when the listener P is at the ideal position, the distance from the speaker SP-L to the listener P and the distance from the speaker SP-R to the listener P are equal to each other.

When the listener P is at the ideal position shown in FIG. 4A, the amplitudes and the arrival times of sound ((1) in FIG. 4A) output from the speaker SP-L and heard by the left ear of the listener P and sound ((3) in FIG. 4A) output from the speaker SP-R and heard by the left ear of the listener P are expressed by a graph shown at the upper side in FIG. 4B. That is, since the speaker SP-L is closer to the left ear of the listener P than the speaker SP-R, the amplitude of the sound output from the speaker SP-L is larger and the arrival time is small.

In this case, the arrival time difference between the sound output from the speaker SP-L and heard by the left ear of the listener P and the sound output from the speaker SP-R and heard by the left ear is expressed by an arrow DL0 in FIG. 4B.

On the other hand, the amplitudes and the arrival times of sound ((2) in FIG. 4A) output from the speaker SP-L and heard by the right ear of the listener P and sound ((4) in FIG. 4A) output from the speaker SP-R and heard by the right ear of the listener P are expressed by a graph shown at the lower side in FIG. 4B. In this case, since the speaker SP-R is closer to the right ear of the listener P than the speaker SP-L, the amplitude of the sound output from the speaker SP-R is larger and the arrival time is small.

The arrival time difference between the sound output from the speaker SP-L and heard by the right ear of the listener P and the sound output from the speaker SP-R and heard by the right ear of the listener P is expressed by an arrow DR0 in FIG. 4B.

The sound output from the speaker SP-L and the sound output from the speaker SP-R are heard by the ears of the listener P in accordance with the times and amplitude levels shown in FIG. 4B, so that an ideal sound-image localization effect can be obtained.

Figure 5A:
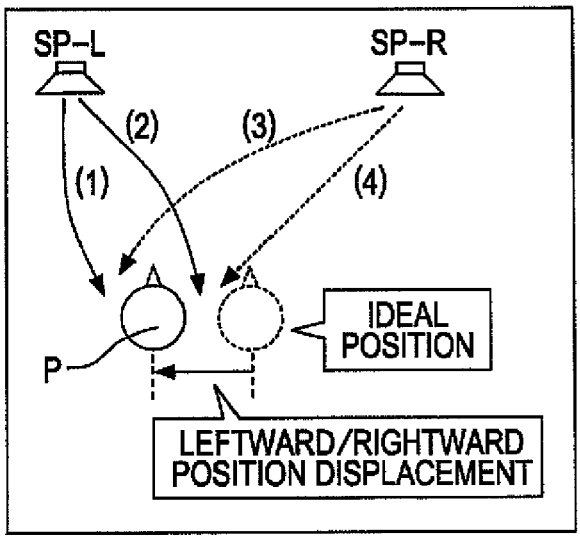
FIGS. 5A and 5B illustrate an arrival time difference between sounds output from the respective speakers and obtained at each ear of the listener when the position of the listener is displaced in the left direction from the ideal listening position.
Figure 5B:
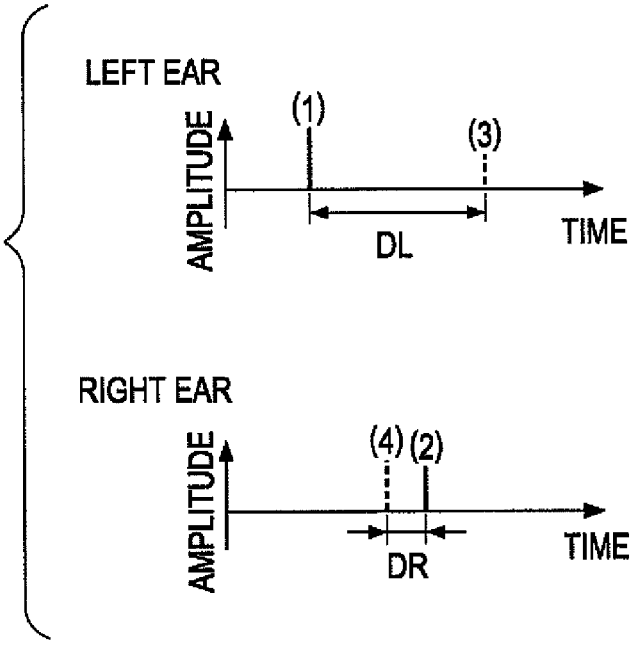

FIGS. 5A and 5B illustrate an arrival time difference between sounds output from the respective speakers SP-L and SP-R and obtained at each ear of the listener P in a case in which the position of the listener P is displaced in the left direction from the ideal listening position, the case being one example of leftward/rightward position displacement.

FIG. 5A schematically shows a state in which sounds output from the speakers SP-L and SP-R arrive at the ears of the listener P and FIG. 5B shows the amplitudes and the arrival times of the sounds output from the speakers SP-L and SP-R and heard by the ears of the listener P in the state shown in FIG. 5A.

When the position of the listener P is displaced in the left direction from the ideal position, the speaker SP-L becomes relatively closer to the listener P. Thus, the amplitudes and the arrival times of sound ((1) in FIG. 5A) output from the speaker SP-L and heard by the left ear of the listener P and sound ((3) in FIG. 5A) output from the speaker SP-R and heard by the left ear are expressed by a graph shown at the upper side in FIG. 5B. The amplitude of the sound output from the speaker SP-L is larger than the amplitude in the case of FIG. 4B and the arrival time is smaller, whereas the amplitude of the sound output from the speaker SP-R is smaller than the amplitude in the case of FIG. 4B and the arrival time is large (i.e., is delayed). As a result, the arrival time difference (DL in FIG. 5B) between the sounds output from the respective speakers SP and obtained at the left ear becomes larger than the arrival time difference DL0 in the case of FIG. 4B.

On the other hand, the amplitudes and the arrival times of sound ((2) in FIG. 5A) output from the speaker SP-L and heard by the right ear of the listener P and sound ((4) in FIG. 5A) output from the speaker SP-R and heard by the right ear of the listener P are expressed by a graph shown at the lower side in FIG. 5B. The amplitude of the sound output from the speaker SP-L is larger than the amplitude in the case of FIG. 4B and the arrival time is smaller, whereas the amplitude of the sound output from the speaker SP-R is smaller than the amplitude in the case of FIG. 4B and the arrival time is large (i.e., is delayed).

As a result, the arrival time difference (DR in FIG. 5B) between the sounds output from the respective speakers SP and obtained at the right ear becomes larger than the arrival time difference DR0 in the case of FIG. 4B.

As described above, when the position of the listener P is displaced in the left or right direction from the ideal listening position, the amplitude and the arrival time of signals that are output from the speakers SP and that arrive at each ear of the listener P differ from those of the signals that are supposed to be received at the ideal listening position. Of the amplitudes and the arrival times, particularly, the difference between the arrival times has more influence on the sound-image localization effect.

Figure 6A:
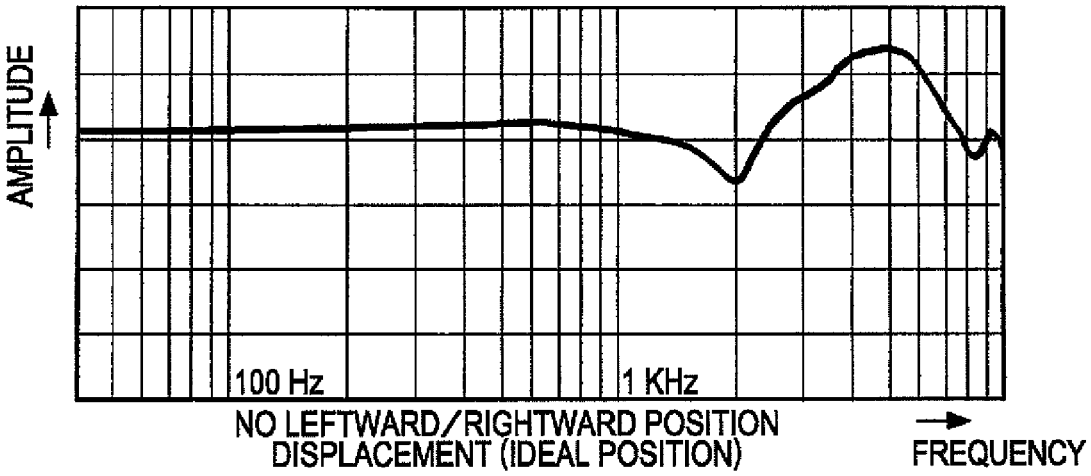
FIGS. 6A to 6C are graphs showing results of measurement of frequency characteristics (frequency-versus-amplitude characteristics) of combined sound of sounds output from the respective speakers, the measurement being performed at the positions of the ears of the listener.
Figure 6B:
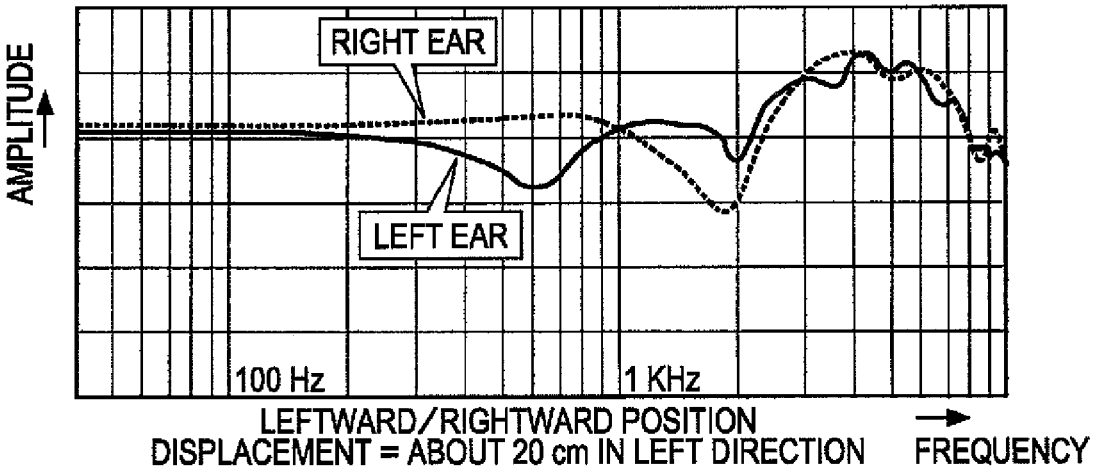
Figure 6C:
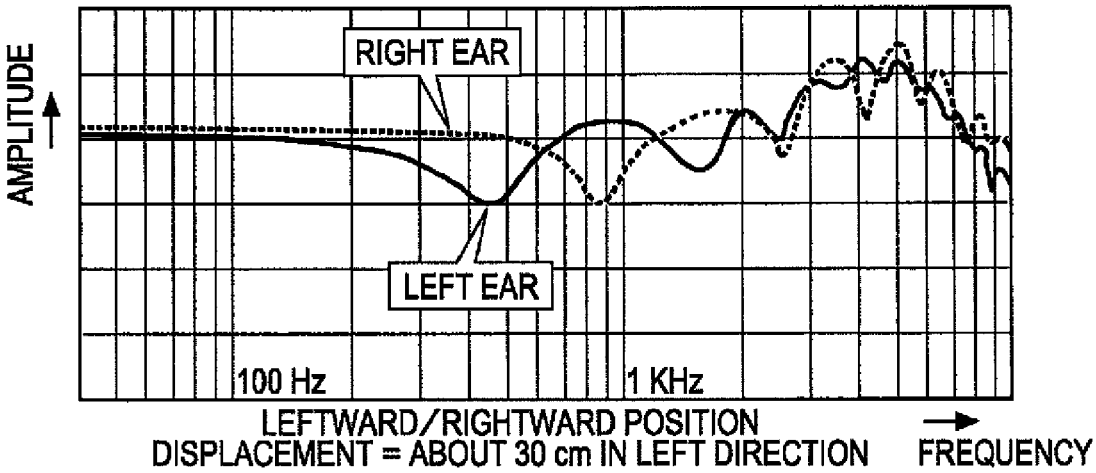

FIGS. 6A to 6C are graphs illustrating results of measurement of frequency characteristics (frequency-versus-amplitude characteristics) of combined sound of sounds output from the speakers SP-L and SP-R, the measurement being performed at the positions of the ears of the listener P. In FIGS. 6A to 6C, the results of measurement performed when the same signal is simultaneously output from both speakers SP-L and SP-R is shown in order to clarify features of the frequency characteristics.

FIG. 6A shows a result of measurement performed when the listener P is at the ideal position, FIG. 6B shows a result of measurement performed when the position of the listener P is displaced in the left direction by about 20 cm, and FIG. 6C shows a result of measurement performed when the position of the listener P is displaced in the left direction by about 30 cm.

In FIGS. 6A to 6C, a frequency characteristic at the left ear of the listener P is indicated by a solid line and a frequency characteristic at the right ear of the listener P is indicated by a dotted line.

As is apparent from the measurement results shown in FIGS. 6A to 6C, when the position of the listener P is displaced in the left or right direction from the ideal position, particularly, the frequency characteristic at the position of the ear located in the direction in which the position of the listener P is displaced (i.e., at the position of the left ear, in this example) exhibits a larger fluctuation. In this case, the fluctuation has a comb-teeth shape and this comb-teeth-shaped fluctuation appears at the higher frequency side than a certain frequency. The frequency at which such a comb-teeth-shaped fluctuation begins to appear will hereinafter be referred to as a "reference-point frequency".

Comparison between FIGS. 6B and 6C shows that when the position of the listener P is displaced from the ideal position, the reference-point frequency with respect to the comb-teeth-shaped fluctuation shifts toward the low frequency side as the amount of displacement increases.

Comparison between FIGS. 6A to 6C shows that the reference-point frequency at the ear located in the direction in which the position of the listener P is displaced has a lower frequency. This can also be understood from the fact that the arrival time difference between sounds output from the respective speakers SP and obtained at the ear located in the position displacement direction has a larger value, as described above with reference to FIGS. 5A and 5B.

Although not shown, an influence associated with such position displacement of the listener P also appears in phase characteristics.

The measurement results shown in FIGS. 6A to 6C are obtained when the same signal is simultaneously output from both speakers SP, and thus, strictly speaking, do not match results of the virtual surround signals Lvs and Rvs that are actually reproduced by the reproducing apparatus 1. In general, since signals having amplitude levels that are substantially equal to each other are often output as virtual surround signals from two speakers in a virtual surround system, how the influence appears is similar to that in the examples shown in FIGS. 6A to 6C.

As can be understood from the measurement results shown in FIGS. 6A to 6C, as the amount of the leftward/rightward position displacement increases, a fluctuation occurs in the frequency characteristics at the ears and a difference between the characteristics at both ears increases. The decrease in the sound-image localization effect is caused by such a difference between the frequency characteristics at both ears.

Service-Area Expansion Processing in First Embodiment

According to the above description, if the difference between the frequency characteristics at both ears, the difference being caused by position displacement of the listener P, is eliminated, it is also possible to prevent loss of a sensation of sound image localization.

At this point, as can be seen from FIGS. 6A to 6C, the reference-point frequency at which the comb-teeth-shaped fluctuation begins to appear tends to be a lower frequency at the ear located in the direction in which the position of the listener P is displaced. Accordingly, when only signals at the lower frequency side than the reference-point frequency at the ear located in the position displacement direction are adapted to be output, the band in which the comb-teeth-shaped fluctuation is generated, including the band at the other ear, can be excluded, and consequently, the difference between the frequency characteristics at both ears of the listener P can be reduced. That is, it is possible to prevent loss of a sensation of sound-image localization.

During the sound reproduction, however, signals in a band higher than the reference-point frequency are also output. Thus, the present embodiment employs a scheme for first outputting signals at lower frequencies than the reference-point frequency and then outputting, as subsequent sound, signals in the other band with a delay.

With such a scheme, a sensation of sound-image localization perceived by the listener P can be dominantly given by the lower frequency side signals that arrive earlier, and an influence of the higher frequency side signals that arrive as subsequent sound can be perceptually reduced. This effect is commonly known as precedence effect.

Even when the position of the listener P is displaced in the left or right direction from the ideal position, the precedence effect makes it possible to reduce loss of a sensation of sound-image localization.

It is desirable to expand the service area that provides the sound-image localization effect during virtual surround reproduction. In order to expand the service area, the first embodiment employs a scheme in which an area in which the sound-image localization effect is ensured is determined. That is, a maximum value that is allowed as the amount of displacement from the ideal position of the listener P is predetermined and the sound-image localization effect is adapted to be ensured in a range up to the maximum value of the amount of displacement.

Accordingly, the band of signals to be output as preceding sound can be determined with reference to the reference-point frequency when the amount of position displacement of the listener P has the maximum value.

Various specific schemes are possible to determine the reference-point frequency when the amount of position displacement has the maximum value.

As one simple example, the reference-point frequency can be measured based on a result of measurement of frequency characteristics as shown in FIGS. 6A to 6C through actual use of a dummy head. More specifically, in this case, the dummy head is placed at a position where the amount of displacement from the ideal position has the maximum value and frequency characteristics of combined sound of sounds output from the respective speakers SP are measured at the ear located in the direction in which the position of the listener P is displaced from the ideal position. Then, the reference-point frequency at which the comb-teeth-shaped fluctuation begins to appear is determined based on a result of the measurement.

Alternatively, without actual measurement of the frequency characteristics, the reference-point frequency can also be determined using the value of the arrival time difference between sounds output from the respective speakers SP.

As described above, the reference-point frequency shifts toward the lower frequency side, as the arrival time difference at the ear located in the direction in which the position of the listener P is displaced increases. This also means that the reference-point frequency has a value that is correlated with the arrival time difference at the ear located in the position displacement direction.

More specifically, when the arrival time difference between sounds output from the respective speakers SP and obtained at the ear located in the direction in which the position of the listener P is displaced from the ideal position is indicated by Dd, the reference-point frequency can be determined based on a value of ½ of the inverse of the arrival time difference Dd.

For example, when the arrival time difference Dd is assumed to be 1 msec ($1/1000$ sec), the frequency at which the comb-teeth-shaped fluctuation begins to appear is generally determined by $1000\times1/2=500$ Hz.

Now, a point where the frequency at which the comb-teeth-shaped fluctuation begins to appear is determined by ½ of the inverse of the arrival time difference Dd will be discussed with reference to FIG. 7.

Figure 7:
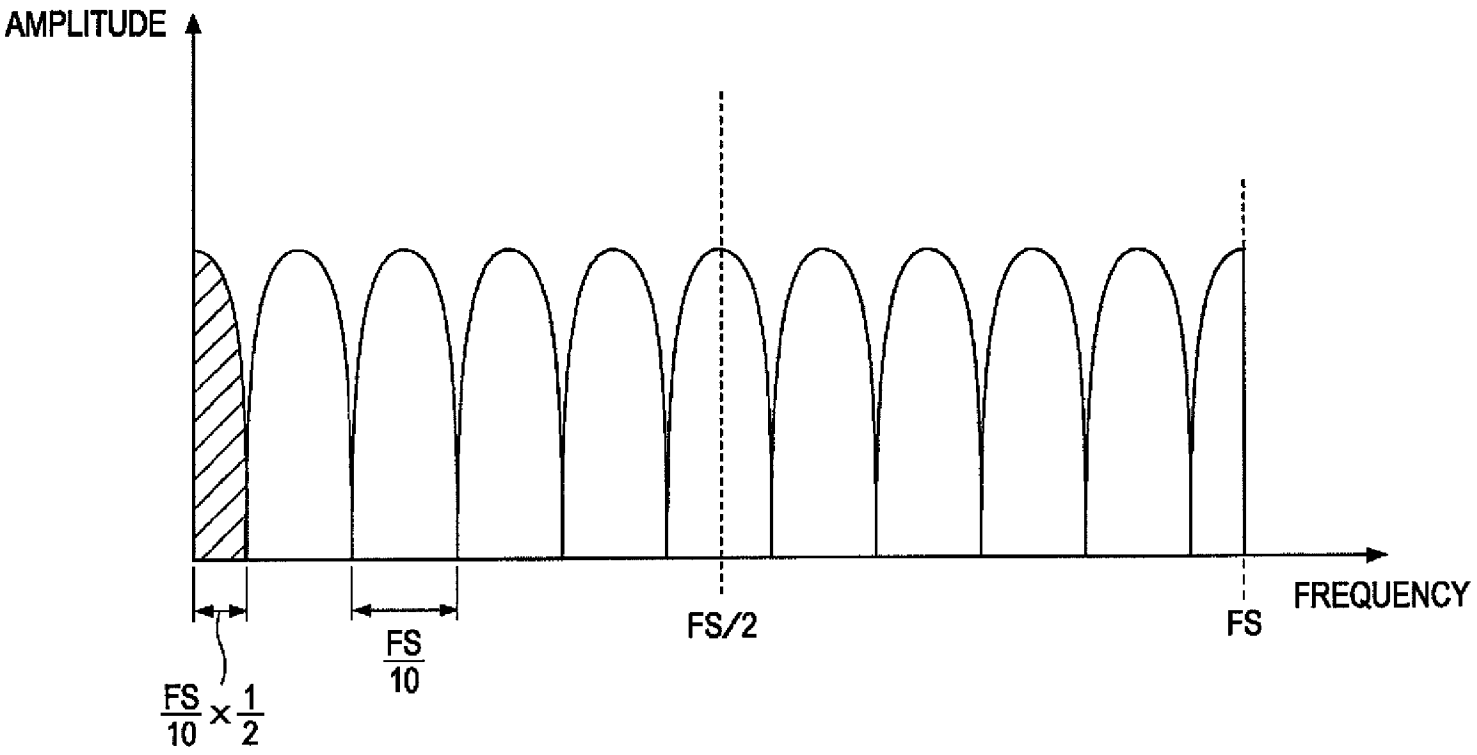
FIG. 7 is a graph illustrating determination of a cutoff frequency on the basis of the value of the arrival time difference between sounds output from the respective speakers and obtained at the position of the ear of the listener.

FIG. 7 shows frequency characteristics measured at the same listening position when the same signal that is flat at entire frequencies is output with a time difference as audio signals at sampling frequencies FS. That is, when the aforementioned same listening position is at the ear of the listener, the time difference corresponds to the arrival time difference between sounds output from the respective speakers SP.

A number of comb teeth, the number corresponding to the given time difference, appear as a frequency characteristic in the range of a direct current (DC) frequency of 0 Hz to a sampling frequency of FS Hz. In the example shown in FIG. 7, a case in which the given time difference corresponds to 10 samples is illustrated. Thus, in this case, 10 comb-teeth are contained in the range up to a frequency of FS Hz.

Thus, when the time difference corresponds to 10 samples, the bandwidth of one comb tooth can be expressed by FS/10 (or, FS/"the number of samples") Hz, as illustrated.

In this case, the band in which no comb-teeth-shaped fluctuation appears, the band being described above with reference to FIGS. 6B and 6C, corresponds to a half-wave comb-tooth band at the lowest frequency shown in FIG. 7. The half-wave comb-tooth bandwidth is expressed by: FS/"the number of samples"×½ Hz. That is, when the time difference illustrated in FIG. 7 corresponds to 10 samples, the frequency at which the comb-teeth-shaped fluctuation begins to appear is determined by FS/10×½ Hz.

When the number of samples is replaced with the amount of time, the frequency at which the comb-teeth-shaped fluctuation begins to appear can similarly be determined.

A description will now be given of an example of a case in which the arrival time difference between sounds output from the respective speakers SP and obtained at the ear of the listener P is 1 msec as in the above-described example. First, when the sampling frequency FS is, for example, 48 kHz, 1 msec is the amount of time corresponding to 48 samples, which is given by $1/1000\div1/48000$. Applying this expression to "FS/(the number of samples)×½" yields $48000/48\times1/2=1000\times1/2=500$ Hz.

As can be understood from the above description, the reference-point frequency at which the comb-teeth-shaped fluctuation begins to appear is generally determined by a value of ½ of the inverse of the value of the arrival time difference Dd at the ear located in the direction in which the position of the listener P is displaced.

As described above, in the first embodiment, the allowable range in which the sound-image localization effect is ensured is set to a fixed range, and the reference-point frequency at which the amount of position displacement is the maximum in the allowable range is determined.

Thus, for actual derivation of the reference-point frequency, first, the value of the arrival time difference between sounds output from the respective speakers SP and obtained at the ear located in the displacement direction when the listener P is at a position where the amount of position displacement is the maximum is determined. That is, the value of the arrival time difference Dd when the listener P is at the position where the amount of position displacement is the maximum is determined.

Then, a value obtained by multiplying the inverse of the value of thus-determined arrival time difference Dd by ½ is determined as the value of the reference-point frequency when the amount of position displacement is the maximum.

The value of the arrival time difference Dd can be determined by actually placing a dummy head at the position where the amount of displacement is the maximum and measuring the arrival time difference between sounds output from the respective speakers.

Alternatively, without use of the dummy head, the value of the arrival time difference Dd can also be determined from the values of the distances from the respective speakers SP to the position where the amount of position displacement is the maximum.

In this case, in a system that performs virtual surround reproduction, an ideal geometric relationship between the speakers SP and the listener P is set to derive transmission functions used for virtualization processing. That is, in the case of this example, the ideal position of the listener P is set at a predetermined position on the central axis between the speakers SP, as illustrated in FIG. 4A.

At the ideal position shown in FIG. 4A, the distances from the listener P to the speakers SP are equal to each other. Also, since the ears of the listener P are commonly formed symmetrically, the arrival time differences between sounds output from the respective speakers SP and obtained at both ears of the listener P also become equal to each other (DL0=DR0), as illustrated in FIG. 4B.

As described above, the band of signals to be output as preceding sound should be set in accordance with the reference-point frequency at the ear located in the direction in which the position of the listener P is displaced. Thus, the arrival time difference at the ear located in the position displacement direction may also be determined as the value of the arrival time difference Dd to be calculated to determine the reference-point frequency.

Using a distance DspL from the listener P to the left speaker SP-L, a distance DspR from the listener P to the right speaker SP-R, and the arrival time difference (DL0 or DR0) between sounds output from the respective speakers SP when the listener P is at the ideal position, the arrival time difference Dd at the ear located in the direction in which the position of the listener P is displaced can be generally determined by:

$$Dp+(|DspL-DspR|)/\text{Sound Speed} \quad \text{(Expression 1)}$$

where DL0=DR0=Dp because of DL0=DR0.

In Expression 1, the values of the arrival time differences (DL0=DR0=Dp) between sounds output from the respective speakers SP and obtained at the left and right ears of the listener P at the ideal position are pre-determined through measurement using a dummy head or the like.

The values of the distances DspL and DspR, however, can be determined by calculation, since a value that is allowed as the amount of position displacement of the listener P (i.e., the maximum amount of position displacement) is determined.

That is, in this case, since the ideal positional relationship of the listener P relative to the speakers SP is pre-determined, it is possible to know the distance from the listener P at the ideal position to each speaker SP, an angle defined by a leftward/rightward axis from the ideal position and an axis that connects the listener P and the speaker SP-L, and an angle defined by the leftward/rightward axis from the ideal position and an axis that connects the listener P and the speaker SP-R.

Since those values are known, the maximum value of the amount of position displacement, the maximum value being used to determine the allowable range, is determined and thus the distances DspL and DspR can be derived by trigonometry. That is, in a triangle that has three points including the ideal position, the position where the amount of displacement has the maximum value, and the position of the speaker SP-L, the distance DspL can be determined from the length of the side between the position where the amount of displacement has the maximum value and the position of the speaker SP-L. At this point, as a result of the determination of the maximum value of the amount of position displacement, the length of the side between the speaker SP-L and the ideal position, the length of the side between the ideal position and the position where the amount of displacement has the maximum value, and the value of the interior angle defined by the two sides are determined. Consequently, the distance DspL can be determined as the length of the side between the position where the amount of displacement has the maximum value and the position of the speaker SP-L.

Similarly, in a triangle that has three points including the ideal position, the position where the amount of displacement has the maximum value, and the position of the speaker SP-R, the distance DspR can be determined from the length of the side between the position where the amount of displacement has the maximum value and the position of the speaker SP-R. As a result of the determination of the maximum value of the amount of position displacement, the length of the side between the speaker SP-R and the ideal position, the length of the side between the ideal position and the position where the amount of displacement has the maximum value, and the value of the interior angle defined by the two sides are determined. Consequently, the distance DspR can be determined as the length of the side between the position where the amount of displacement has the maximum value and the position of the speaker SP-R.

As described above, the distance DspL from the listener P to the left speaker SP-L and the distance DspR from the listener P to the right speaker SP-R can be determined from the calculation, thus making it possible to eliminate time and effort for actually measuring the distances.

[Configuration of Service-Area Expansion Processing Unit]

A configuration for realizing the service-area expansion processing according to the first embodiment described above will now be described.

Figure 8:
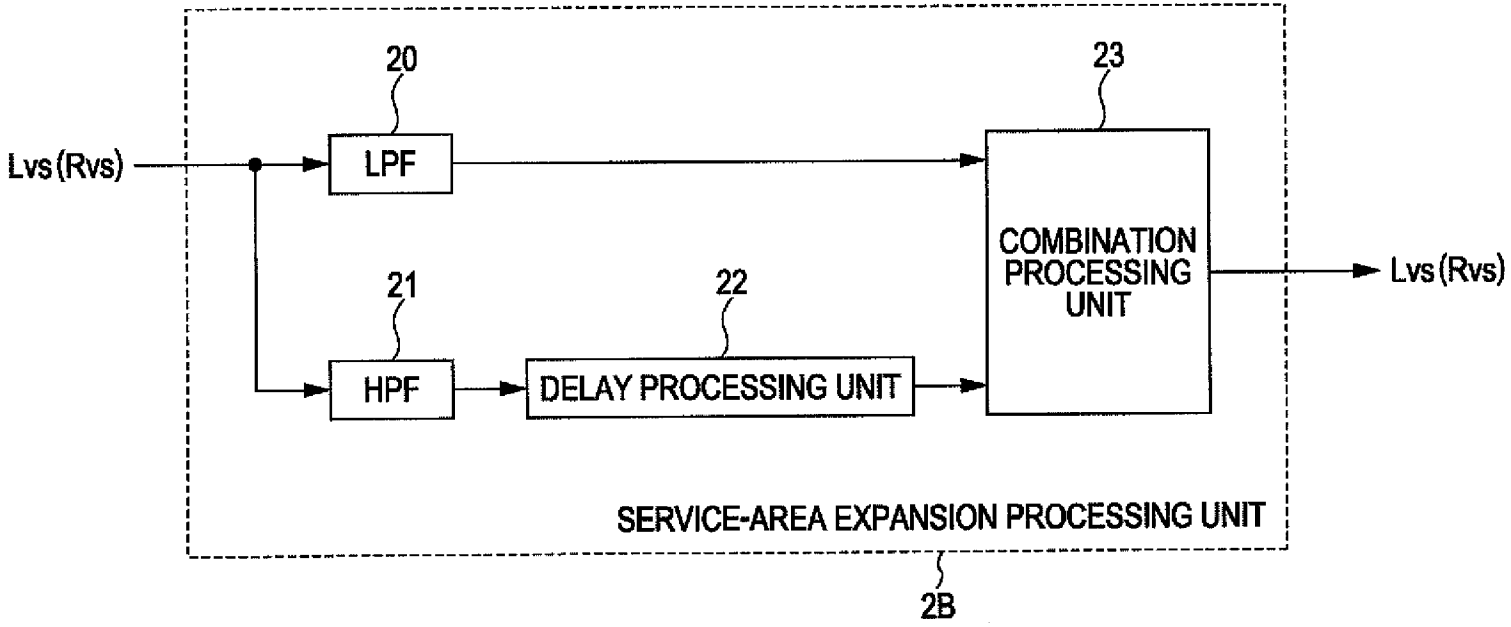
FIG. 8 is block diagram of a functional operation of a service-area processing unit in the first embodiment.

FIG. 8 is a block diagram showing a functional operation of the service-area expansion processing unit 2B described above with reference to FIG. 2.

In FIG. 8, each functional block is also described as hardware. Each functional operation is realized by the digital signal processing based on the signal processing program 5*a*, the processing being performed by the 2-channel virtual-surround-signal generating unit 2 implemented by the DSP.

As described with reference to FIG. 2, two service-area expansion processing units 2B are provided, one of which receives and processes the left-channel virtual surround signal Lvs and the other receives and processes the right-channel virtual surround signal Rvs.

Since the configurations of the two service-area expansion processing units 2B may have the same configuration, descriptions there of are collectively given in FIG. 8. For convenience of description, the left and right virtual surround signals Lvs and Rvs are collectively referred to as "virtual surround signals vs".

In FIG. 8, the service-area expansion processing unit 2B includes a low-pass filter (LPF) 20, a high-pass filter (HPF) 21, a delay processing unit 22, and a combination processing unit 23.

The virtual surround signal vs output from the virtualization processing unit 2A shown in FIG. 2 is split into a signal supplied to the LPF 20 and a signal supplied to the HPF 21.

A frequency based on the reference-point frequency predetermined as described above is set for the LPF 20 and the HPF 21 as a cutoff frequency thereof. More specifically, a frequency that is lower than at least the reference-point frequency is set as the cutoff frequency.

As a result, the LPF 20 extracts, of the virtual surround signal vs, signal components having lower frequencies at which the fluctuation in the frequency characteristic is small. The HPF 21 extracts, of the virtual surround signal vs, signal components having higher frequencies than at least the reference-point frequency.

The signal components extracted by the LPF 20 are supplied to the combination processing unit 23.

On the other hand, the signal components extracted by the HPF 21 are delayed by a predetermined amount of time by the delay processing unit 22, and are then supplied to the combination processing unit 23.

The combination processing unit 23 combines the signal components output from the LPF 20 and the signal components output from the delay processing unit 22 and outputs the resulting virtual surround signal vs.

The virtual surround signal vs obtained by the combination processing performed by the combination processing unit 23 is supplied to the corresponding D/A convert 3L or 3R (shown in FIG. 1) as an output signal of the service-area expansion processing unit 2B. Consequently, sounds based on the virtual surround signals vs subjected to the service-area expansion processing performed by the service-area expansion processing units 2B are output from the speakers SP-L and SP-R.

This arrangement, therefore, provides a precedence effect as described above and can ensure the sound-image localization effect within the allowable range of a preset amount of position displacement. That is, this arrangement can expand the service area having the sound-image localization effect, compared to the related art.

It is desirable in this case that not only high and middle frequency components but also a small amount of low frequency component be contained in the signal components output as subsequent sound, in order to adequately obtain the precedence effect. Thus, in this case, a relatively gentle (slope) characteristic, such as −6 dB/octave or −12 dB/octave, not a steep characteristic, is set as the cutoff characteristic of the HPF 21 that separates high and middle frequency components.

Figure 9:
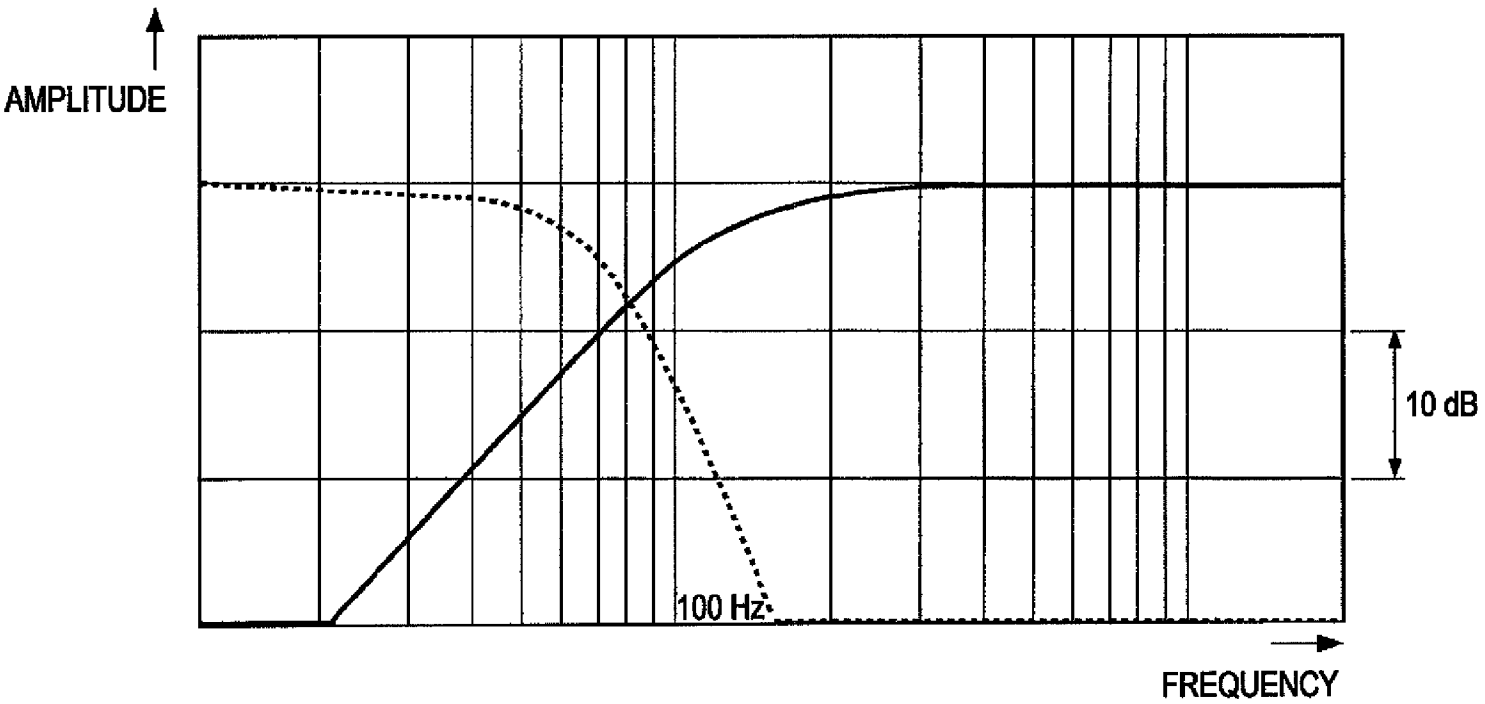
FIG. 9 is a graph illustrating a cutoff frequency of a low-pass filter (LPF) and a high-pass filter (HPF)

FIG. 9 is a graph illustrating a cutoff characteristic of the HPF 21 based on the above-described point.

In FIG. 9, a cutoff characteristic of the LPF 20 is also shown by a dotted line, for comparison. It can be seen from FIG. 9 that the cutoff characteristic of the LPF 20 is relatively steep, whereas the cutoff characteristic of the HPF 21 is set to be gentler.

It is also desirable that the amount of delay of high and middle frequency components output as subsequent sound be set within the range of about 1 to 30 msec in order to obtain the precedence effect. Thus, the amount of time delay in the range of about 1 to 30 msec is also set for the delay processing unit 22.

Strictly speaking, however, the amount of time delay is set considering the cutoff frequency (the reference-point frequency) to be set.

In this case, when a certain amount of delay time is set, naturally, an arrival time difference occurs between preceding sound (low frequencies) and subsequent sound (high and middle frequencies) at each ear of the listener P. Such a arrival time difference between the preceding sound and the subsequent sound causes a comb-teeth-shaped fluctuation at frequencies higher than or equal to a frequency corresponding to the arrival time difference (i.e., the set amount of delay time, in this case) in the frequency characteristics at each ear of the listener P, according to a principle that is similar to the principle described above in the scheme for deriving the cutoff frequency (the reference-point frequency). Strictly speaking, a fluctuation in the frequency characteristics can occur at the interface at which the preceding sound and the subsequent sound are combined.

Thus, the fluctuation can be reduced when a state in which only signals in a band in which no comb-teeth-shaped fluctuation occurs are output earlier is obtained. In order to obtain such a state, the apparatus may be configured so as to satisfy a condition that the set cutoff frequency becomes lower than the frequency at which the comb-teeth-shaped fluctuation begins to appear, the frequency being determined in accordance with a setting value of the amount of delay time. In other words, the amount of delay time may be set so that the frequency at which the comb-teeth-shaped fluctuation begins to appear in frequency characteristics with respect to combined sound of preceding sound and subsequent sound, the frequency characteristics being dependent on the setting of the amount of delay time, has a higher value than the set cutoff frequency.

A specific example will now be described. For example, when the sampling frequency is 48 kHz and the amount of time delay is set to 1 msec (which corresponds to 48 samples), the frequency at which the comb-teeth-shaped fluctuation begins to appear in the frequency characteristic is 500 Hz, which is given by 48000/48×½. Accordingly, when the cutoff frequency is 500 Hz or lower, the setting of the amount of time delay to 1 msec makes it possible to prevent a frequency-characteristic fluctuation that occurs at the interface at which the preceding sound and subsequent sound are combined. This arrangement, therefore, makes it possible to provide more appropriate audio tones.

Thus, when the amount of delay time to be set is increased, the frequency at which the comb-teeth-shaped fluctuation occurs at the interface at which the preceding sound and subsequent sound are combined decreases correspondingly. Conversely, when the amount of delay time to be set is reduced, the frequency at which the comb-teeth-shaped fluctuation occurs increases. Therefore, when the set cutoff frequency is low, the amount of delay time can be set to have a large value correspondingly, and conversely, when the set cutoff frequency is high, the amount of delay time can be set to have a small value correspondingly.

In the case of this example, the cutoff frequency is set to have a value corresponding to a maximum allowable amount of position displacement. That is, the amount of delay time in this case may be set so that the frequency at which the comb-teeth-shaped fluctuation begins to appear in the frequency characteristics with respect to combined sound of preceding sound and subsequent sound, the frequency characteristics being dependent on the setting of the amount of delay time, has a higher value than the cutoff frequency set according to the maximum amount of position displacement.

As can be understood from the above-described relationship between the value of the arrival time difference Dd and the value of the reference-point frequency, determination of the inverse of twice the value of the frequency can determine the value of the amount of delay time. Thus, a threshold for the amount of delay time to be set can be determined based on the inverse of a value obtained by multiplying the set cutoff frequency by 2. That is, the amount of delay time to be actually set can be set to have a value smaller than at least the threshold determined.

The LPF 20 and the HPF 21 in the service-area expansion processing unit 2B shown in FIG. 8 may have any filter configurations as long as they are functionally satisfactory. That is, the LPF 20 and the HPF 21 may be configured with infinite impulse response (IIR) filters or may be configured with FIR filters (using linear integration along a time axis or a circular integration along a frequency axis). In the case of FIR filters, the arrangement can be such that the HPF 21 and the delay processing unit 22 are combined together. In addition, the arrangement can also be such that the LPF 20, the HPF 21, and the delay processing unit 22 are combined together.

The combination processing performed by the combination processing unit 23 in the service-area expansion processing unit 2B is not limited to the simple addition processing. For example, the combination processing may also be performed in conjunction with phase adjustment and so on so that the frequency characteristics after the combination processing do not vary significantly. In particular, when the phase characteristics of the LPF 20 and HPF 21 have a reverse phase relationship in a frequency band in which the gains thereof overlap each other, deduction processing is performed in the combination processing.

<Second Embodiment>

[Configuration of Reproducing Apparatus]

A second embodiment will be described next.

In the second embodiment, the cutoff frequency (i.e., the service area) is variably set in accordance with the actual position of the listener P, unlike the case of the first embodiment in which the pre-fixed service area is determined.

Figure 10:
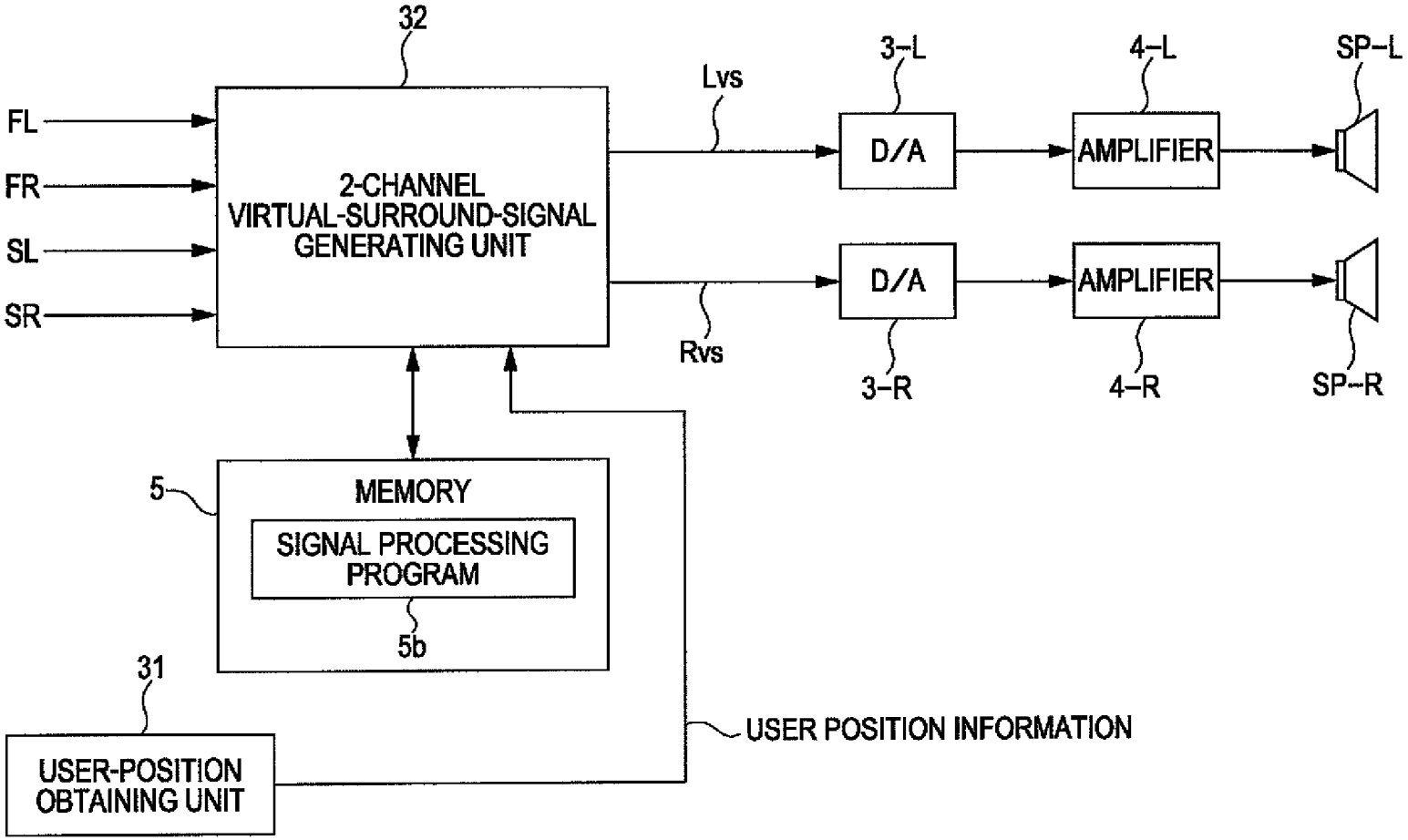
FIG. 10 is a block diagram showing the internal configuration of a reproducing apparatus according to a second embodiment.

FIG. 10 is a block diagram showing the internal configuration of a reproducing apparatus 30 according to the second embodiment. The reproducing apparatus 30 according to the second embodiment is different from the reproducing apparatus 1 according to the first embodiment in that a user-position obtaining unit 31 is further provided and the functional operation of the 2-channel virtual-surround-signal generating unit 2 is modified. In FIG. 10, the same units as those illustrated in FIG. 1 are denoted by the same reference numerals, and descriptions thereof are not given hereinbelow.

The reproducing apparatus 30 shown in FIG. 10 includes a 2-channel virtual-surround-signal generating unit 32. Similarly to the 2-channel virtual-surround-signal generating unit 2 shown in FIG. 1, upon receiving a left-channel audio signal FL (L), a right-channel audio signal FR (R), a left-channel surround signal SL, and a right-channel surround signal SR, the 2-channel virtual-surround-signal generating unit 32 performs signal processing for providing a left-channel virtual surround signal Lvs and a right-channel virtual surround signal Rvs for expanding the service area.

The 2-channel virtual-surround-signal generating unit 32 is also implemented by a DSP. A memory 5 in this case stores a signal processing program 5*b* for causing the DSP to perform signal processing, described below, according to the second embodiment.

The reproducing apparatus 30 further includes the user-position obtaining unit 31.

The user-position obtaining unit 31 is provided to obtain information indicating the listening position of a listener (user) P.

In this case, the user-position obtaining unit 31 is configured so as to allow the user to perform an operation for inputting information indicating his/her listening position. More specifically, the user-position obtaining unit 31 includes an operation input unit and an information processing unit. The operation input unit includes, for example, various buttons and keys for operation. The information processing unit includes a microcomputer or the like having, for example, a central processing unit (CPU), and obtains information indicating the user's listening position on the basis of operation input information sent from the operation input unit.

For the information processing unit in the user-position obtaining unit 31, for example, information regarding predetermined multiple listening positions are pre-set. In this case, the information regarding the listening positions includes information regarding the ideal position and information for identifying positions that represent the amounts of displacement from the ideal position. More specifically, the information regarding the listening positions provides information indicating the positions in terms of the amounts of displacement from the ideal position.

The information processing unit displays, on a display unit (not shown) or the like, information representing the listening positions to present the information to the user.

The user operates the operation input unit to perform an operation for selecting, from the presented listening position information, the listening position information that matches the actual listening position.

On the basis of the operation input information that is sent from the operation input unit in accordance with such a user operation, the information processing unit obtains the information of the selected listening position.

As described above, the user-position obtaining unit 31 obtains the information of the listening position of the user (the listener) P.

Figure 11:
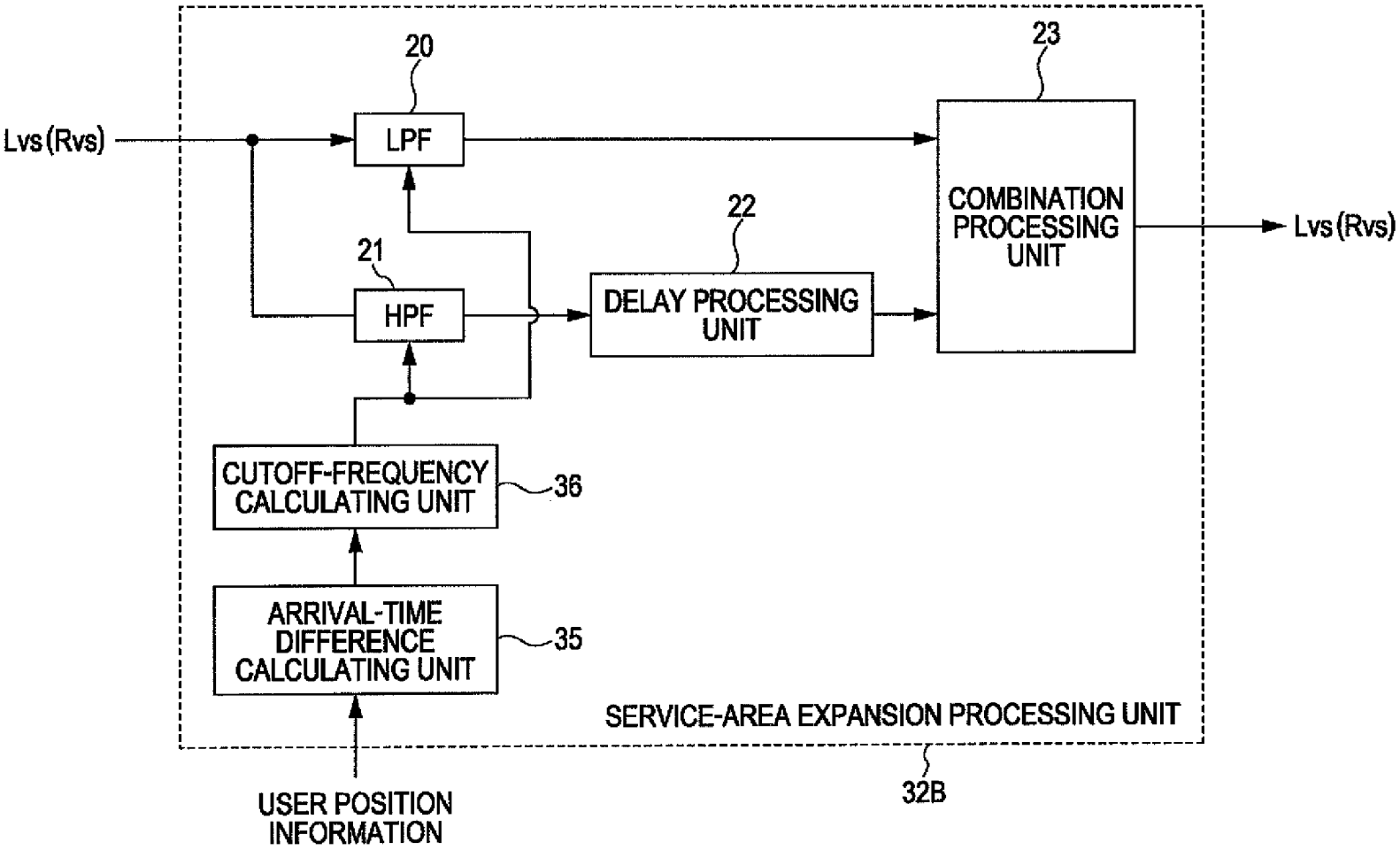
FIG. 11 is block diagram of a functional operation of a service-area processing unit in the second embodiment.

The user-position obtaining unit 31 supplies the obtained listening position information to the 2-channel virtual-surround-signal generating unit 32 as user position information, as shown in FIGS. 10 and 11.

FIG. 11 is a block diagram showing a functional operation realized by executing the digital signal processing based on the above-described signal processing program 5b, the digital signal processing being performed by the 2-channel virtual-surround-signal generating unit 32 shown in FIG. 10, and particularly showing only a functional operation that serves as a service-area expansion processing unit 32B.

Although not shown, the 2-channel virtual-surround-signal generating unit 32 according to the second embodiment also performs a functional operation as a virtualization processing unit 2A for generating virtual surround signals Lvs and Rvs from audio signals FL and FR and surround signals SL and SR, as in the case of the first embodiment described above. Since the functional operation that serves as the virtualization processing unit 2A is the same as the functional operation described above with reference to FIG. 2, a description thereof is not given hereinbelow.

In the second embodiment, two service-area expansion processing units 32B are provided, one of which receives and processes the left-channel virtual surround signal Lvs generated by the virtualization processing unit 2A and the other one receives and processes the right-channel virtual surround signal Rvs. Since the configurations of the functional blocks in the service-area expansion processing units 32B are analogous to each other, the configuration of only one of the processing units 32B is illustrated in FIG. 11, as in the case of FIG. 8.

As can be seen from comparison between FIG. 8 and FIG. 11, a configuration for outputting frequency signal components that are low relative to the cutoff frequency with respect to the virtual surround signal Lvs or the virtual surround signal Rvs (or the virtual surround signal vs) generated by the virtualization processing unit 2A is analogous to the configuration (including the LPF 20, the HPF 21, the delay processing unit 22, and the combination processing unit 23) shown in FIG. 8.

The service-area expansion processing unit 32B is different from the service-area expansion processing unit 2B shown in FIG. 8 in that an arrival-time difference calculating unit 35 and a cutoff-frequency calculating unit 36 are further provided to variably set the cutoff frequency of the LPF 20 and the HPF 21 in accordance with the above-described user position information.

The arrival-time difference calculating unit 35 calculates the value of the arrival time difference Dd on the basis of the user position information sent from the user-position obtaining unit 31 shown in FIG. 10. That is, the arrival-time difference calculating unit 35 determines a larger one of the values of the arrival time differences between sounds output from the respective speakers SP and obtained at both ears of the listener P (i.e., determines the value of the arrival time difference between sounds output from the respective speakers SP and obtained at the ear located in the displacement direction).

More specifically, on the basis of the information (the user position information) indicating the amount of displacement in the left or right direction from the ideal position, the arrival-time difference calculating unit 35 determines the values of distances DspL and DspR from the position (i.e., the position of the listener P) indicated by the user position information to the corresponding speakers SP-L and SP-R. Using the values of the distances DspL and DspR, the arrival-time difference calculating unit 35 performs calculation given by Expression 1, described above, to determine the value of the arrival time difference.

In this case, for determination of the distances DspL and DspR from the user position information, association information in which the listening positions and the distances DspL and DspR are pre-associated with each other is used. More specifically, in the association information, the values of the distances DspL and DspR from each user position to the speakers SP-L and SP-R are associated with the information of the user positions (i.e., the information of the listening positions) that can be specified via the user-position obtaining unit 31 (the information processing unit).

Although not shown, the association information is, for example, stored in the memory 5 shown in FIG. 10. The arrival-time difference calculating unit 35 determines the values of the distances DspL and DspR on the basis of the association information and the input user position information.

Thus, the arrival-time difference calculating unit 35 performs calculation given by Expression 1 using the distances DspL and DspR.

In this case, the calculation given by Expression 1 uses the value of the arrival time difference Dp (=DL0=DR0) at the ideal position. The value of the arrival time difference Dp is, for example, pre-stored in the memory 5. The arrival-time difference calculating unit 35 reads the value of the arrival time difference Dp and performs the calculation given by Expression 1 using the distances DspL and DspR. As a result of the processing, the value of the arrival time difference Dd which is a larger one of the values of the arrival time differences between sounds output from the respective speakers SP and obtained at both ears of the listener P is determined.

As described above in the first embodiment, determination of the value of the amount of displacement in the left or right direction from the ideal position allows the values of the distances DspL and DspR from the positions of the listener P to the speakers SP to be determined using trigonometry. Thus, the arrival-time difference calculating unit 35 can also be configured to determine the distances DspL and DspR by using such trigonometry-based calculation.

In this case, since the calculation of the distances DspL and DspR uses an angle defined by an axis along the position of the listener P (the ideal position) and the speaker SP-L and an leftward or rightward axis and an angle defined by an axis along the position of the listener P (the ideal position) and the speaker SP-R and a leftward or rightward axis. Thus, the information of those angles is pre-set. The information of the angles is, for example, pre-stored in the memory 5. The arrival-time difference calculating unit 35 may be configured to read and use the information of the angles to perform calculation.

The value of the arrival time difference Dd calculated by the arrival-time difference calculating unit 35 is supplied to the cutoff-frequency calculating unit 36.

The cutoff-frequency calculating unit 36 determines the value of the reference-point frequency by multiplying the inverse of the value of the arrival time difference Dd by ½. The cutoff-frequency calculating unit 36 then determines the cutoff frequency on the basis of the value of the reference-point frequency and issues an instruction so that the cutoff frequency is set for the LPF 20 and HPF 21. As a result, filter characteristics corresponding to the cutoff frequency are set for the LPF 20 and the HPF 21. In this case, for example, specific characteristics as shown in FIG. 9 can also be set.

As described above, according to the second embodiment, the cutoff frequency can be variably set in accordance with the position of the listener P. That is, this arrangement allows the service area having the sound-image localization effect to be variably set in accordance with the position of the listener P.

According to the second embodiment, since the sound-image localization effect can also be maintained even when the position of the listener P is displaced from the ideal position, it is possible to expand the service area having the sound-image localization effect.

In the case of the first embodiment described above, since the cutoff frequency is set to a frequency that is assumed to be the lowest, the frequency band of signals output as preceding sound, i.e., the effective band having the precedence effect, is relatively small. In the second embodiment, however, since the cutoff frequency can be variably set in accordance with the position of the listener P, an appropriate bandwidth corresponding to the position of the listener P can be ensured without over-limitation of the effective band having the precedence effect.

In the second embodiment, the amount of delay time that is substantially equal to that in the first embodiment may be set for the delay processing unit 22.

That is, in the case of the second embodiment, the amount of delay time may also be set so that the frequency at which the comb-teeth-shaped fluctuation begins to appear in the frequency characteristics with respect to combined sound of preceding sound and subsequent sound, the frequency characteristics being dependent on the setting of the amount of delay time, has a smaller value than the cutoff frequency to be set when the amount of position displacement is the maximum.

Alternatively, in the case of the second embodiment, the amount of delay time can also be variably set in accordance with the cutoff frequency set according to the user position.

As described above, the threshold of the amount of delay time when a characteristic fluctuation at the interface at which the preceding sound and subsequent sound are combined is considered is determined by the inverse of twice a value of a set cutoff frequency. Thus, when the amount of delay time is to be variably set, the above-described calculation is performed with respect to the set cutoff frequency to determine the threshold of the amount of delay time and the amount of delay time is set to have a smaller value than the threshold.

[Modifications]

While embodiments of the present invention have been described above, the present invention is not limited to the specific examples described above.

A configuration according to a modification will be described below.

Figure 12:
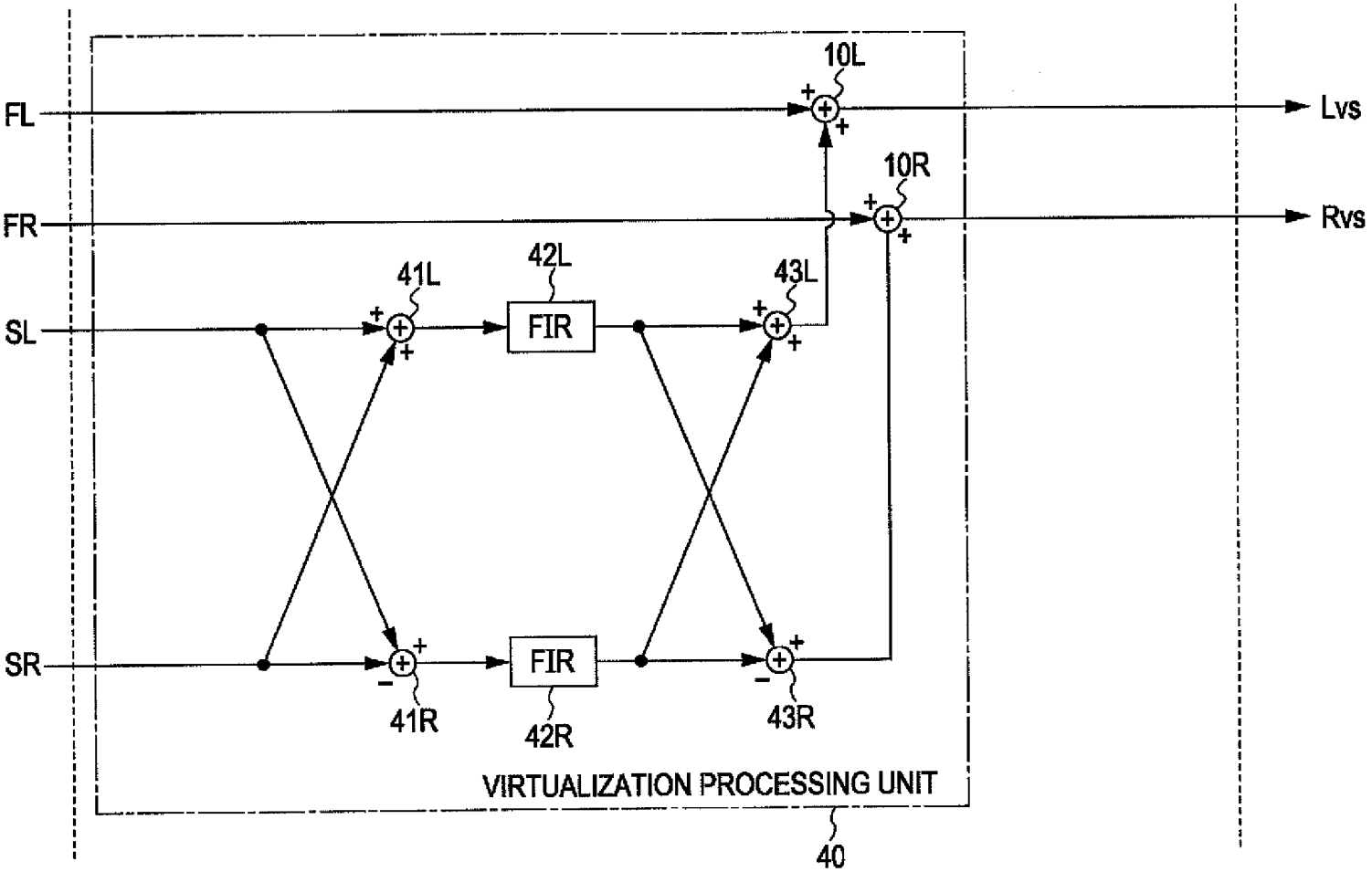
FIG. 12 is a diagram illustrating a modification of the virtualization processing unit.

FIG. 12 is a diagram illustrating a modification of the virtualization processing unit.

This modification is directed to a case in which the number of filters for performing virtualization processing is reduced when a state in which the speakers SP-L and SP-R are symmetrically disposed, viewed from the listener P, is assumed to the ideal state.

FIG. 12 is a block diagram of a functional operation realized by the digital signal processing of the 2-channel virtual-surround-signal generating unit 2 or 32 implemented by the DSP. A virtualization processing unit 40 shown in FIG. 12 replaces the virtualization processing unit 2A described in the first and second embodiments.

In FIG. 12, as in the case described above, the left-channel audio signal FL is input to an addition processing unit 10L and the right-channel audio signal FR is input to an addition processing unit 10R.

On the other hand, the left-channel surround signal SL is split into a signal input to an addition processing unit 41L and a signal input to an addition/deduction processing unit 41R. The right-channel surround signal SR is split into a signal input to the addition/deduction processing unit 41R and a signal input to the addition processing unit 41L.

The addition processing unit 41L adds both signals input as described above. A result of the addition performed by the addition processing unit 41L is supplied to an FIR filter 42L.

On the other hand, the addition/deduction processing unit 41R deducts the right-channel surround signal SR from the left-channel surround signal SL. A result of the deduction performed by the addition/deduction processing unit 41R is supplied to an FIR filter 42R.

The FIR filters 42L and 42R give predetermined signal characteristics to the corresponding input signals. Filter characteristics are appropriately set for the FIR filters 42L and 42R so that the left-channel surround signal SL and the right-channel surround signal SR are perceived by the listener P as sounds output from the rear left and the rear right, respectively, based on the sound transmission functions H1L, H1R, H2R, H2L, G1L, G1R, G2R, and G2L described above with reference to FIG. 3.

An output of the FIR filter 42L is split input to a signal input to an addition processing unit 43L and a signal input to an addition/deduction processing unit 43R. An output of the FIR filter 42L is split input to a signal input to the addition/deduction processing unit 43R and a signal input to the addition processing unit 43L.

The addition processing unit 43L adds both the input signals. A result of the addition preformed by the addition processing unit 43L is input to the addition processing unit 10L and is added to the left-channel audio signal FL.

The addition/deduction processing unit 43R deducts the output of the FIR filter 42R from the output of the FIR filter 42L. A result of the deduction performed by the addition/deduction processing unit 43R is input to the addition processing unit 10R and is added to the right-channel audio signal FR.

With this arrangement, it is possible to generate virtual surround signals Lvs and Rvs that are similar to those generated by the virtualization processing unit 2A described above. That is, in this case, the number of filter processing units used for the virtualization processing can be reduced compared to the case using the configuration of the virtualization processing unit 2A, so that the processing load of the DSP is reduced and the hardware resources can also be reduced.

For generation of the virtual surround signals Lvs and Rvs, signals subjected to binaural recording or signals pre-subjected to binaural processing can also be input as the left-channel surround signal SL and the right-channel surround signal SR. In this case, the arrangement can be such that the filter processing units 11L, 11R, 12L, and 12R and the addition processing units 13L and 13R, which are shown in FIG. 2, are eliminated or the addition processing unit 41L, the addition/deduction processing unit 41R, and the FIR filters 42L and 42R, which are shown in FIG. 12, are eliminated.

When signals subjected to binaural recording or pre-subjected to binaural processing are input as the left-channel surround signal SL and the right-channel surround signal SR, the arrangement can also be such that the left-channel audio signal FL, the right-channel audio signal FR, and the addition processing units 10L and 10R are eliminated.

Figure 13:
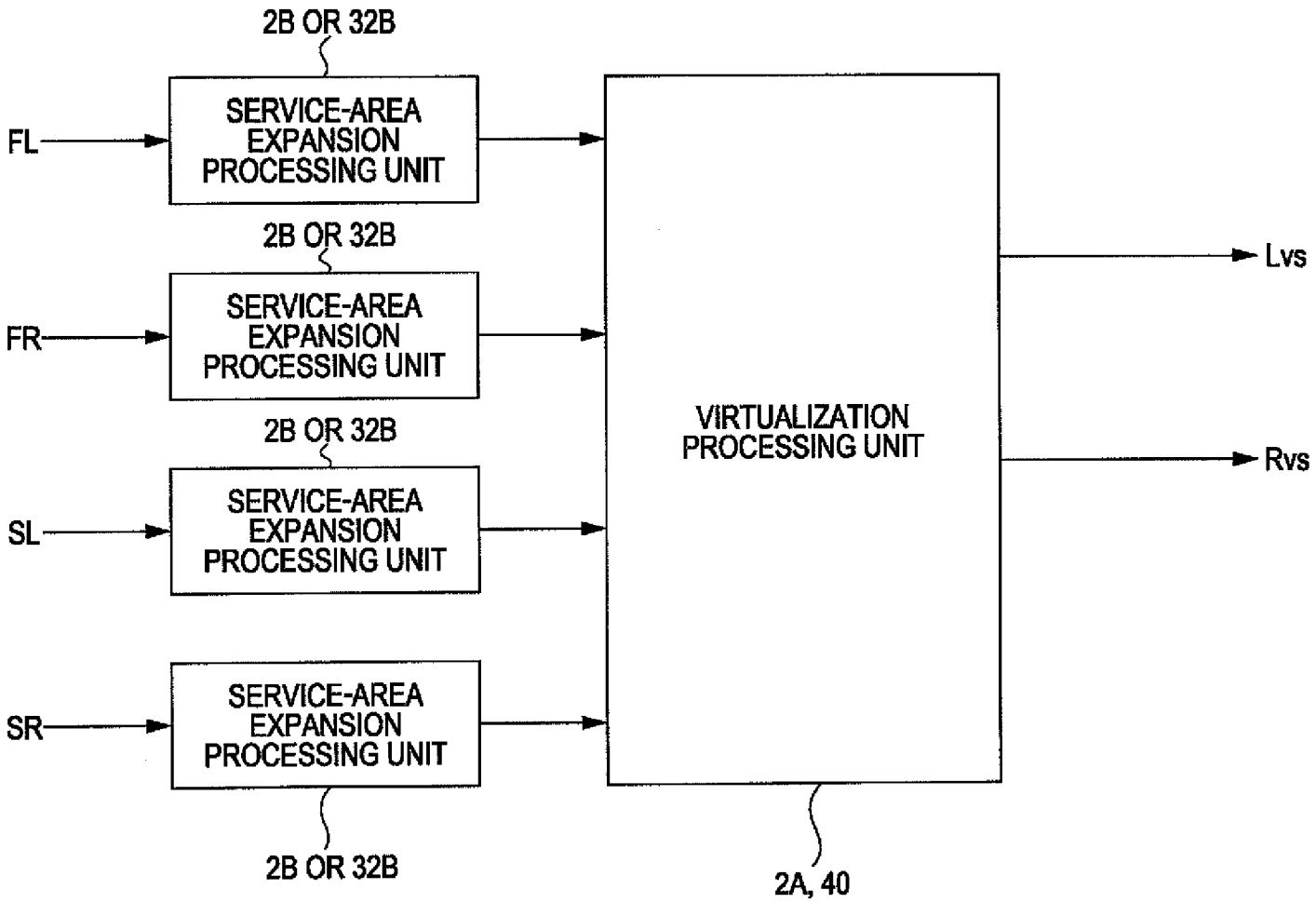
FIG. 13 is block diagram showing a configuration according to a first modification.
Figure 14:
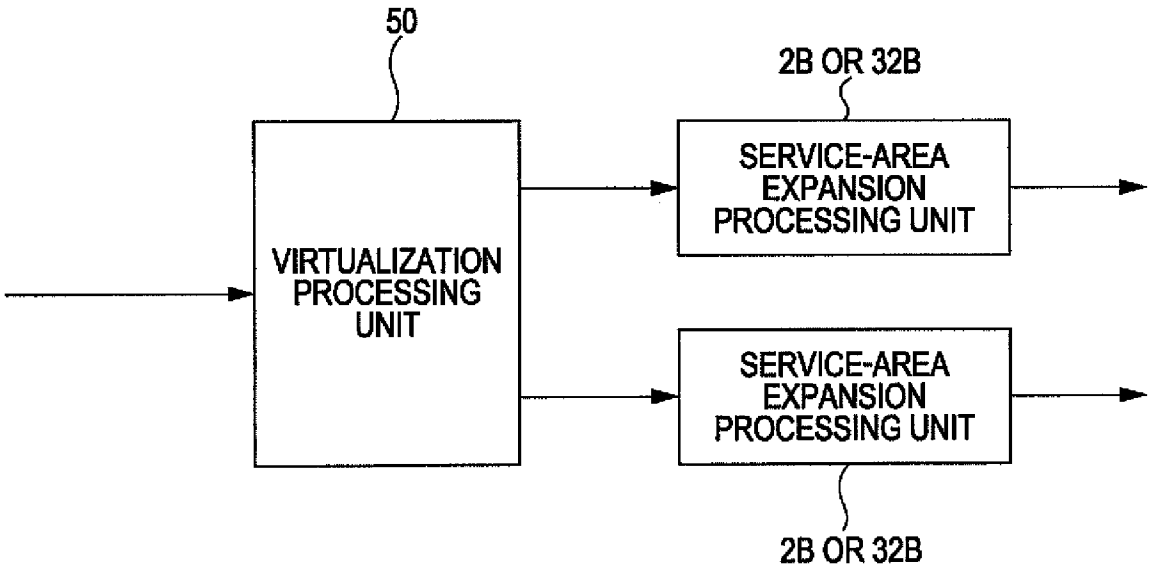
FIG. 14 is block diagram showing a configuration according to a second modification.
Figure 15:
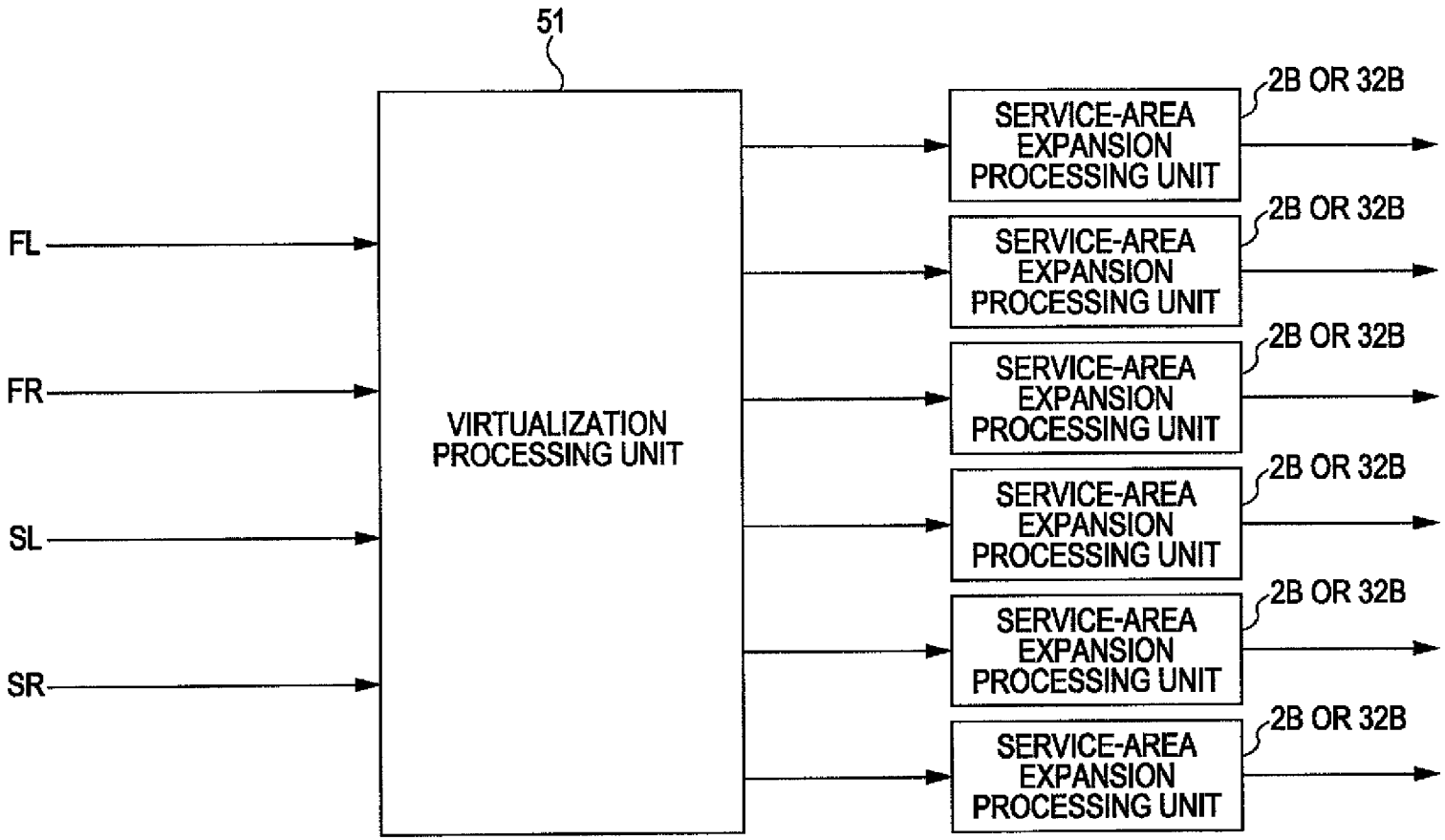
FIG. 15 is block diagram showing a configuration according to a third modification.

FIGS. 13 to 15 are diagrams illustrating the configuration of first to third modifications.

A first modification shown in FIG. 13 is a modification regarding a position at which the service-area expansion processing is performed.

Although the service-area expansion processing units 2B or 32B perform service-area expansion processing on the signals that were subjected to the virtualization processing performed by the virtualization processing unit 2A or 40 in the above description, the service-area expansion processing can also be performed on signals prior to the virtualization processing. That is, when the virtualization processing is the so-called "linear processing" band-wise, the overall output signals (Lvs and Rvs) obtained when the virtual processing is performed at the subsequent stage, as illustrated in the above-described embodiments, and the overall output signals (Lvs and Rvs) obtained when the virtual processing is performed at a prior stage, as shown in FIG. 13, are substantially equal to each other.

In the latter case, as shown in FIG. 13, the service-area expansion processing units 2B or 32B are provided for all-channel signals input to the virtualization processing unit 2A or 40.

A second modification shown in FIG. 14 is an example of the configuration for a case in which the number of input channels is 1 and the number of output channels is 2 or more.

A virtualization processing unit 50 in this case generates 2-channel virtual surround signals from a 1-channel input audio signal. Service-area expansion processing units 2B or 32B for performing service-area expansion processing according to the embodiment are provided for the virtual surround signals generated for the respective channels.

Although not shown, when the virtualization processing is the so-called "linear processing" band-wise as in the case described above, the service-area expansion processing units 2B or 32B can be provided at a stage prior to the virtualization processing. That is, in such a case, the service-area expansion processing units 2B or 32B are provided for one-channel audio signal input to the virtualization processing unit 50 shown in FIG. 14. Naturally, provision of the service-area expansion processing units 2B or 32B at the stage prior to the virtualization processing unit 50 in such a manner makes it possible to reduce the processing load and hardware resources.

A third modification shown in FIG. 15 is an example of the configuration for a case in which the number of final audio output channels is greater than 2.

In the example shown in FIG. 15, the number of input channels for the virtualization processing is 4 and the number of output channels is 6. More specifically, a virtualization processing unit 51 shown in FIG. 15 receives the left-channel audio signal FL, the right-channel audio signal FR, the left-channel surround signal SL, and the right-channel surround signal SR and generates 6-channel output signals therefrom.

Thus, the service expansion processing units 2B or 32B are provided for the respective-channel signals generated by the virtualization processing unit 51.

In the third modification, the service-area expansion processing may also be performed at a stage prior to the virtualization processing. In this case, provision of the service-area expansion processing units 2B or 32B at a prior stage also makes it possible to reduce the number of service-area expansion processing units 2B or 32B.

The present invention is not limited to the above-described configuration examples including the above-described modifications, and is also preferably applicable to a system for performing virtual surround reproduction at frequencies including low frequencies.

Although the above description has been given of examples of a case in which the service-area expansion processing according to the present invention is realized by the digital signal processing using DSP, the signal processing according to the invention can also be realized by a hardware configuration, for example, by configuring the functional blocks, described above with reference to the figures, with hardware.

Although the above description in the second embodiment has been given of an example of the configuration in which the user-position obtaining unit 31 has the operation input unit and the information processing unit and obtains the information indicating the position of the listener P on the basis of an operation input, another configuration may also be employed.

For example, the position information of the listener P can also be obtained based on a result of analysis of a captured image.

In this case, the user-position obtaining unit 31 includes, for example, a camera unit for capturing an image of the listener P at an approximate center between the speakers SP and an image analyzing unit for performing image analysis on the image captured by the camera unit. The image analyzing unit identifies a portion showing the face of the person in the captured image, by using, for example, a face recognition technology, and determines the value of the amount of displacement in the left or right direction from the ideal position of the listener P, on the basis of information indicating the position of the identified portion in the image. The value of the amount of displacement is obtained as the user position information.

Performing such image analysis to identify the user position information allows the value of the amount of leftward/rightward displacement of the listener P to be obtained in real time. That is, the above-described service-area expansion processing units 32B are operated based on the information of the amount of displacement, the information being obtained in real time as described above, so that the service area can be variably set in real time in accordance with the actual position of the listener P.

Various other schemes are also possible to obtain the user position information.

For example, when a remote controller for the reproducing apparatus 30 is available, a scheme for identifying the position of the listener P on the basis of the position of the remote controller may also be employed. This scheme is based on the premise that the listener P listens to sound, for example, while he or she holds the remote controller in his/her hand(s) or the remote controller is placed at a position, adjacent to the hand(s) or the like.

In the case, the user-position obtaining unit 31 identifies the position of the remote controller, on the basis of a reception result of a signal sequentially transmitted by the remote controller. Position information obtained in such a manner is used as the user position information.

The above description has been given of examples of a case in which only the amount of displacement in the left or right direction from the ideal position is considered with respect to the displacement of the position of the listener P, based on the premise that a decrease in the sound-image localization effect is greatly affected by, particularly, the displacement in the left or right direction. Needless to say, the amount of frontward or rearward displacement may also be considered to more reliably expand the service area.

In this case, information regarding a frontward or rearward distance from the listener P is used and can be obtained as described below. For example, when the user-position obtaining unit 31 includes a camera unit and an image analyzing unit, as described above, the frontward or rearward distance can be estimated from the image size of a portion showing a person's face during the image analysis.

Alternatively, when the camera unit has a focusing function, the frontward or rearward distance can be estimated from information indicating a focused focal-point distance.

When a configuration in which the user position information is obtained is employed as in the second embodiment, sounds in all bands may be simultaneously output without separately outputting preceding sound and subsequent sound when the position of the listener P matches the ideal position.

For example, switching between operations in such a case may be controlled by the user-position obtaining unit 31. That is, in this case, the user-position obtaining unit 31 determines whether or not position information identified based on the operation input or the image analysis matches the ideal position. When the identified position information does not match the ideal position, the user-position obtaining unit 31 may issue an instruction to the 2-channel virtual-surround-signal generating units 32 so that the functional operation of the service-area expansion processing units 32B is executed. When the identified position information matches the ideal position, the user-position obtaining unit 31 may issue an instruction to the 2-channel virtual-surround-signal generating units 32 so that the functional operation of the service-area expansion processing units 32B is not executed.

Although the description in the second embodiment has been given of an example of only a case in which the cutoff frequency is determined based on the value of the arrival time difference between sounds output from the respective speakers SP, the arrangement can also be such that the cutoff frequency is determined based on a result of actual measurement of frequency characteristics.

In such a case, the reproducing apparatus 30 is configured so that, at least, signals of sound picked up from a microphone or microphones can be input thereto. During the measurement, the microphone(s) is placed adjacent to the ear(s) of the listener P who is at a position where he/she actually listens to sound. In this state, for example, test signals, such as time stretched pulses (TSPs), are output from the speakers SP, signals picked up from the microphone(s) are obtained, and frequency characteristics of sounds output from the speakers SP are measured based on the signals of the picked up sound. The reference-point frequency at which a comb-teeth-shaped fluctuation begins to appear in the frequency characteristics is detected, and a cutoff frequency to be set for the LPF 20 and the HPF 21 is determined based on the detected reference-point frequency.

In this case, the reference-point frequency to be determined for setting the cutoff frequency is the reference-point frequency for the ear at which the value of the arrival time difference between sounds output from the respective speakers SP is larger. That is, of the reference-point frequencies with respect to the positions of both ears, a lower reference-point frequency is determined. Thus, when the microphones are disposed at the positions of both ears to measure frequency characteristics at the positions of the ears, a lower reference-point frequency of the reference-point frequencies for the ears is selected. Alternatively, when the microphone is placed at only the ear located in the direction in which the position of the listener P is displaced from the ideal position to measure the frequency characteristics, only the reference-point frequency to be determined can be detected. This arrangement can eliminate the selection of the lower reference-point frequency.

When such a scheme for measuring the frequency characteristics is employed, the cutoff frequency can be set more accurately, but microphones may be required and/or the user' time and effort for the measurement may be required. In contrast, when a scheme for determining the reference-point frequency by using calculation based on an operation input or image analysis, as described above, is employed, for example, the user's load for operations, such as an operation for selecting the listening position and an operation for the image analysis, can be eliminated. Thus, the service area can be more easily expanded.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing apparatus, comprising:

a low-pass-filter processing unit configured to perform processing for limiting a low-frequency audio band of an input audio signal below a reference frequency that lies between the low-frequency audio band and a high-frequency audio band, wherein the reference frequency is set dynamically in real time by the signal processing apparatus responsive to movement of a listener and is based on a position of the listener and corresponds to a frequency at which a characteristic fluctuation appears in frequency characteristics with respect to combined sound at positions of ears of the listener who listens to sound output from speakers and being set for the low-pass-filter processing unit;

a high-pass-filter processing unit configured to perform processing for limiting the high-frequency audio band of the input audio signal above the reference frequency, wherein the reference frequency for the band-limited audio signal of the high-pass-filter processing unit is the same as the reference frequency for the band-limited audio signal of the low-pass-filter processing unit;

a delay processing unit configured to perform processing for delaying the audio signal band-limited by the high-pass-filter processing unit for a selected time after the audio signal band-limited by the low-pass-filter processing unit; and a combination processing unit configured to combine the audio signal band-limited by the low-pass-filter processing unit and the audio signal subjected to the delay processing performed by the delay processing unit, wherein the signal processing apparatus is configured to detect and analyze positions of the listener in real time while the listener uses the signal processing apparatus.

2. The signal processing apparatus according to claim 1, further comprising:

an arrival-time difference calculating unit configured to determine a value of arrival time differences between sounds output from the respective speakers and obtained at the positions of the ears of the listener, based on input information regarding a listening position of the listener; and a reference-frequency calculating unit configured to determine the reference frequency based on a value obtained by multiplying an inverse of the arrival-time difference value, determined by the arrival-time difference calculating unit, by ½.

3. The signal processing apparatus according to claim 2, wherein the value of the arrival-time difference, Dp, between sounds output from the respective speakers when the listener who is at a pre-set ideal listening position listens to the sounds output from the speakers is pre-set for the arrival-time difference calculating unit;

the arrival-time difference calculating unit determines the value of the arrival-time difference between the sounds output from the respective speakers and obtained at the ear at which the value of the arrival-time difference is larger than the arrival-time difference between the sounds obtained at the other ear, by performing a calculation given by $$Dp+(|DspL-DspR|)/\text{sound speed},$$

based on a value of a distance, DspL, from one of the speakers to the listener, a value of a distance, DspR, from another one of the speakers to the listener, and the value of the arrival-time difference, Dp, the values of the distances DspL and DspR being obtained based on the input information; and the arrival-time difference calculating unit determines the value of the reference frequency based on the arrival-time difference value determined by the calculation.

4. The signal processing apparatus according to claim 2, further comprising an operation input unit configured to receive an operation input, and wherein the input information regarding the listening position of the listener includes information of the operation input received by the operation input unit.

5. The signal processing apparatus according to claim 2, further comprising:

a camera unit configured to capture an image; and an image analyzing unit configured to analyze the image, captured by the camera unit, to identify the position of the listener;

wherein the arrival-time difference calculating unit obtains, as the information regarding the listening position of the listener, information of the listener position identified by the image analyzing unit.

6. The signal processing apparatus according to claim 1, wherein the signal processing apparatus provides signals to drive only two audio speakers.

7. The signal processing apparatus of claim 1, wherein the selected time imparts a precedence effect to the combination of the audio signal band-limited by the low-pass-filter processing unit and the audio signal subjected to the delay processing.

8. The signal processing apparatus of claim 1, wherein the selected time is in a range of about 1 millisecond to about 30 milliseconds.

9. The signal processing apparatus of claim 1, wherein the high-pass-filter processing unit passes some mid-range and low-frequency audio signals as low as 40 Hz.

10. The signal processing apparatus of claim 1, wherein the detected positions of the ears of the listener are determined from images captured of the listener's head.

11. The signal processing apparatus of claim 1, wherein the position of the listener is determined from signals received from a remote controller.

12. The signal processing apparatus of claim 1, wherein the low-pass-filter processing unit has a sharper cutoff than the high-pass-filter processing unit.

13. A signal processing method for an audio system, comprising the steps of:

performing low-pass-filter processing for limiting a low-frequency audio band of an input audio signal below a reference frequency that lies between the low-frequency audio band and a high-frequency audio band, wherein the reference frequency corresponds to a frequency at which a characteristic fluctuation appears in frequency characteristics with respect to combined sound at positions of ears of a listener who listens to sound output from speakers;

performing high-pass-filter processing for limiting the high-frequency audio band of the input audio signal above the reference frequency, wherein the reference frequency for the band-limited audio signal of the high-pass-filter processing is the same as the reference frequency for the band-limited audio signal of the low-pass-filter processing;

performing delay processing for delaying the audio signal band-limited in the high-pass-filter processing step for a selected time after the audio signal band-limited in the low-pass-filter processing step;

detecting positions of the listener in real time while the listener uses the audio system;

setting the reference frequency dynamically in real time responsive to real-time movement of the listener and based at least upon the detected positions of the listener; and performing combination processing for combining the audio signal band-limited in the low-pass-filter processing step and the audio signal subjected to the delay processing in the delay processing step.

14. The method of claim 13, further comprising creating a precedence effect by delaying the audio signal band-limited in the high-pass-filter in a range of about 1 millisecond to about 30 milliseconds after the band-limited audio signal of the low-pass-filter processing.

15. The method of claim 14, further comprising detecting the position of the listener based upon images captured of the listener's head.

16. The method of claim 14, further comprising detecting the position of the listener based upon signals received from a remote controller.

17. The method of claim 14, further comprising passing audio signals as low as 40 Hz by the high-pass-filter when creating the precedence effect.

18. A non-transitory storage medium that stores a program for a signal processing apparatus that performs signal processing on an input audio signal, the program causing the signal processing apparatus to execute:

performing low-pass-filter processing for limiting a low-frequency audio band of an input audio signal below a reference frequency that lies between the low-frequency audio band and a high-frequency audio band, wherein, the reference frequency corresponds to a frequency at which a characteristic fluctuation appears in frequency characteristics with respect to combined sound at positions of ears of a listener who listens to sound output from speakers;

performing high-pass-filter processing for limiting the high-frequency audio band of the input audio signal above the reference frequency, wherein the reference frequency for the band-limited audio signal of the high-pass-filter processing is the same as the reference frequency for the band-limited audio signal of the low-pass-filter processing;

performing delay processing for delaying the audio signal band-limited by the high-pass-filter processing for a selected time after the audio signal band-limited by the low-pass-filter processing;

setting the reference frequency in real time responsive to real-time movement of the listener based at least upon detected positions of the listener that are obtained and analyzed in real time while the listener uses the signal processing apparatus; and performing combination processing for combining the audio signal band-limited by the low-pass-filter processing and the audio signal subjected to the delay processing.

* * * * *